US009751656B2

(12) United States Patent
Wolf

(10) Patent No.: US 9,751,656 B2
(45) Date of Patent: Sep. 5, 2017

(54) BEVERAGE CONTAINER

(71) Applicant: LBP Manufacturing LLC, Cicero, IL (US)

(72) Inventor: Kurt Wolf, Chicago, IL (US)

(73) Assignee: LBP Manufacturing LLC, Cicero, IL (US)

( * ) Notice: Subject to any disclaimer, the term of this patent is extended or adjusted under 35 U.S.C. 154(b) by 7 days.

(21) Appl. No.: 15/055,259

(22) Filed: Feb. 26, 2016

(65) Prior Publication Data

US 2016/0251109 A1 Sep. 1, 2016

Related U.S. Application Data

(60) Provisional application No. 62/121,607, filed on Feb. 27, 2015.

(51) Int. Cl.

| | |
|---|---|
| ***B65D 5/74*** | (2006.01) |
| ***B65D 5/40*** | (2006.01) |
| ***B65D 5/42*** | (2006.01) |
| ***B65D 77/06*** | (2006.01) |
| ***B65D 5/46*** | (2006.01) |

(52) U.S. Cl.

CPC ..... *B65D 5/746* (2013.01); *B65D 5/40* (2013.01); *B65D 5/4208* (2013.01); *B65D 5/4266* (2013.01); *B65D 5/46104* (2013.01); *B65D 77/062* (2013.01)

(58) Field of Classification Search

CPC .. B65D 5/746; B65D 77/062; B65D 5/46104; B65D 5/40; B65D 5/4208; B65D 5/4266

USPC ..... 222/105, 465.1

See application file for complete search history.

(56) References Cited

U.S. PATENT DOCUMENTS

| | | | |
|---|---|---|---|
| 181,014 | A | 8/1876 | Scott |
| 720,864 | A | 2/1903 | Walter |
| 1,129,778 | A | 2/1915 | Baldwin |
| 1,527,399 | A | 2/1925 | Davison |

(Continued)

FOREIGN PATENT DOCUMENTS

| | | |
|---|---|---|
| AU | 493047 | 5/1978 |
| EP | 273102 | 7/1987 |

(Continued)

OTHER PUBLICATIONS

Examination Report issued in related Taiwan Application No. 104304666 dated Feb. 19, 2016 and English translation of the same (6 pages).

(Continued)

*Primary Examiner* — Donnell Long

(74) *Attorney, Agent, or Firm* — Fitch, Even, Tabin & Flannery LLP

(57) ABSTRACT

A beverage container having an outer shell and an inner flexible bladder or bag having a spout for receiving a liquid therein. The container is erectable and is formed from a unitary blank of material, such as corrugated paperboard. The container includes a plurality of walls that extend from a base, and a top having first and second inclined portions that meet at an apex. The spout is oriented vertically upwardly and may be disposed in an inclined wall portion to provide various advantages, including allowing a user to fill and transport the beverage container in the same orientation. The inclined wall portion also improves pouring characteristics and visibility of the spout.

22 Claims, 13 Drawing Sheets

(56) References Cited

U.S. PATENT DOCUMENTS

| | | | | |
|---|---|---|---|---|
| 1,532,316 | A | 4/1925 | Kaufman | |
| 1,984,611 | A | 12/1934 | Weaver | |
| 2,413,721 | A | 1/1947 | Lobl | |
| 2,574,931 | A | 11/1951 | Nason, Jr. | |
| 2,618,409 | A | 11/1952 | Eisenberger et al. | |
| 2,638,210 | A | 5/1953 | Sparks | |
| 2,714,982 | A | 8/1955 | Strauss | |
| 2,946,494 | A | 7/1960 | Kuss | |
| 2,954,901 | A | 10/1960 | Winstead | |
| 2,990,101 | A | 6/1961 | Mead et al. | |
| 3,054,549 | A | 9/1962 | Humphrey | |
| 3,087,655 | A | 4/1963 | Scholle | |
| 3,090,526 | A | 5/1963 | Hamilton et al. | |
| 3,119,543 | A | 1/1964 | Walker | |
| 3,126,140 | A | 3/1964 | Lizan et al. | |
| 3,140,811 | A | 7/1964 | Hall et al. | |
| 3,143,249 | A | 8/1964 | Merrill et al. | |
| 3,160,326 | A | 12/1964 | Sturdevant et al. | |
| 3,163,544 | A | 12/1964 | Valyi | |
| 3,169,690 | A | 2/1965 | Scholle | |
| 3,173,579 | A | 3/1965 | Curie et al. | |
| 3,186,625 | A | 6/1965 | Mead et al. | |
| 3,227,322 | A | 1/1966 | Crain | |
| 3,233,817 | A * | 2/1966 | Casady | B65D 77/065 222/105 |
| 3,349,986 | A | 10/1967 | Chapman et al. | |
| 3,363,807 | A | 1/1968 | Powell | |
| 3,416,719 | A | 12/1968 | Pilger | |
| 3,484,011 | A | 12/1969 | Greenhalgh et al. | |
| 3,785,254 | A | 1/1974 | Mann | |
| 3,927,824 | A | 12/1975 | Razziano | |
| 3,931,916 | A | 1/1976 | Blue et al. | |
| 4,209,092 | A | 6/1980 | Jones | |
| D261,861 | S | 11/1981 | Carter | |
| 4,308,995 | A | 1/1982 | Hanes | |
| D267,475 | S | 1/1983 | Maroszek et al. | |
| 4,375,864 | A | 3/1983 | Savage | |
| D271,944 | S | 12/1983 | Wood | |
| 4,471,884 | A | 9/1984 | Kuchenbecker | |
| 4,560,090 | A | 12/1985 | Okushita | |
| 4,653,671 | A | 3/1987 | Duffy et al. | |
| 4,658,961 | A | 4/1987 | Tamura | |
| 4,771,917 | A | 9/1988 | Heaps, Jr. et al. | |
| 4,781,314 | A | 11/1988 | Schoonover et al. | |
| 4,815,631 | A | 3/1989 | Eeg et al. | |
| 5,048,691 | A | 9/1991 | Heuberger et al. | |
| 5,050,775 | A | 9/1991 | Marquardt | |
| 5,054,644 | A | 10/1991 | Greenslade | |
| 5,074,429 | A | 12/1991 | Konkel et al. | |
| 5,092,486 | A | 3/1992 | vom Hofe et al. | |
| 5,106,015 | A | 4/1992 | Vlasaty et al. | |
| 5,125,566 | A | 6/1992 | Deiger | |
| 5,147,062 | A | 9/1992 | Heuberger et al. | |
| 5,147,071 | A | 9/1992 | Rutter et al. | |
| 5,156,295 | A | 10/1992 | Gordon et al. | |
| 5,163,485 | A | 11/1992 | Hermann | |
| 5,169,019 | A | 12/1992 | Budenbender | |
| 5,176,313 | A | 1/1993 | Curry et al. | |
| 5,193,712 | A | 3/1993 | Kuppersbusch | |
| 5,201,462 | A | 4/1993 | Sada et al. | |
| 5,263,339 | A | 11/1993 | Evans | |
| 5,265,753 | A | 11/1993 | Moorman | |
| D346,738 | S | 5/1994 | Kinigakis | |
| D350,692 | S | 9/1994 | Seki | |
| 5,392,958 | A | 2/1995 | Kurtzahn et al. | |
| 5,482,179 | A | 1/1996 | Bruhn | |
| 5,562,228 | A | 10/1996 | Ericson | |
| 5,704,541 | A | 1/1998 | Mogard | |
| 5,715,992 | A | 2/1998 | Andrews, Sr. et al. | |
| D394,209 | S | 5/1998 | Millet | |
| 5,769,028 | A | 6/1998 | Deckys | |
| 5,769,273 | A | 6/1998 | Sasaki et al. | |
| D396,805 | S | 8/1998 | Broyles | |
| D401,148 | S | 11/1998 | Bouraoui et al. | |
| 5,829,637 | A | 11/1998 | Takemura et al. | |
| 5,897,050 | A | 4/1999 | Barnes | |
| 5,909,841 | A | 6/1999 | Andrews, Sr. et al. | |
| 5,950,831 | A | 9/1999 | Millet | |
| D418,751 | S | 1/2000 | Wolf | |
| 6,053,401 | A | 4/2000 | Andrews, Sr. | |
| D424,433 | S | 5/2000 | Perkins et al. | |
| D425,413 | S | 5/2000 | Heeley et al. | |
| 6,062,431 | A | 5/2000 | Geshay | |
| 6,105,821 | A | 8/2000 | Christine et al. | |
| 6,139,187 | A | 10/2000 | Galomb et al. | |
| 6,164,526 | A | 12/2000 | Dalvey | |
| 6,168,074 | B1 | 1/2001 | Petriekis et al. | |
| D437,218 | S | 2/2001 | Ljunstrom et al. | |
| 6,182,887 | B1 | 2/2001 | Ljunstrom et al. | |
| 6,196,452 | B1 | 3/2001 | Andrews, Sr. et al. | |
| 6,209,781 | B1 | 4/2001 | Sylvester et al. | |
| D442,859 | S | 5/2001 | Hirschey | |
| 6,223,981 | B1 | 5/2001 | Gunder | |
| 6,228,011 | B1 | 5/2001 | Takemura et al. | |
| 6,253,993 | B1 | 7/2001 | Lloyd et al. | |
| 6,290,124 | B2 | 9/2001 | Andrews, Sr. et al. | |
| D454,492 | S | 3/2002 | Dammers | |
| D475,284 | S | 6/2003 | Bomer | |
| RE38,377 | E | 1/2004 | Geshay | |
| D494,861 | S | 8/2004 | Guidotti et al. | |
| 7,066,869 | B2 | 6/2006 | Cook et al. | |
| 7,077,309 | B2 | 7/2006 | Andrews, Sr. | |
| D526,206 | S | 8/2006 | Varlet | |
| D527,998 | S | 9/2006 | Nixon | |
| D548,071 | S | 8/2007 | Chen | |
| 7,255,261 | B2 | 8/2007 | Mesly | |
| D567,079 | S | 4/2008 | Fant | |
| D578,876 | S | 10/2008 | Ambelang et al. | |
| D586,221 | S | 2/2009 | Shaikh | |
| 7,571,835 | B2 | 8/2009 | Hill et al. | |
| D609,088 | S | 2/2010 | Kvam | |
| 7,681,783 | B2 | 3/2010 | Stephenson | |
| D616,739 | S | 6/2010 | Kalberer | |
| D617,635 | S | 6/2010 | Gould | |
| D622,139 | S | 8/2010 | Marcott et al. | |
| D625,600 | S | 10/2010 | Hill | |
| D652,293 | S | 1/2012 | Sander | |
| D663,198 | S | 7/2012 | White et al. | |
| D670,163 | S | 11/2012 | Lauritzen | |
| D674,690 | S | 1/2013 | Sill | |
| D679,094 | S | 4/2013 | Scott | |
| D680,425 | S | 4/2013 | Boswell | |
| D684,853 | S | 6/2013 | Dagnino | |
| D685,633 | S | 7/2013 | Thomas | |
| D686,882 | S | 7/2013 | Chiu et al. | |
| D688,939 | S | 9/2013 | Pearson et al. | |
| D690,195 | S | 9/2013 | Kalberer et al. | |
| D690,590 | S | 10/2013 | Fux | |
| D693,677 | S | 11/2013 | Pearson et al. | |
| 8,627,999 | B2 | 1/2014 | Wolf et al. | |
| D701,455 | S | 3/2014 | Shepherd et al. | |
| D702,117 | S | 4/2014 | Dagnino | |
| D713,721 | S | 9/2014 | Graves | |
| D744,825 | S | 12/2015 | Johansen | |
| D748,496 | S | 2/2016 | Young et al. | |
| 2002/0047040 | A1 | 4/2002 | Andrews, Sr. et al. | |
| 2003/0024950 | A1 | 2/2003 | Yoneyama et al. | |
| 2004/0180770 | A1 | 9/2004 | Cook et al. | |
| 2005/0211754 | A1 | 9/2005 | Fulcher | |
| 2006/0202005 | A1 | 9/2006 | Andrews, Sr. et al. | |
| 2006/0243783 | A1 | 11/2006 | Spivey, Sr. et al. | |
| 2010/0127057 | A1 | 5/2010 | Burke | |
| 2011/0253774 | A1 | 10/2011 | Hill | |
| 2014/0374447 | A1 | 12/2014 | Coogan et al. | |

FOREIGN PATENT DOCUMENTS

| | | |
|---|---|---|
| EP | 1127807 | 8/2001 |
| GB | 1161713 | 8/1969 |
| GB | 1529062 | 10/1978 |
| JP | 9164609 | 6/1997 |
| JP | D1400012 | 11/2010 |

(56) References Cited

FOREIGN PATENT DOCUMENTS

| | | |
|---|---|---|
| JP | D1450074 | 9/2012 |
| WO | 9221587 | 12/1992 |
| WO | 9311050 | 6/1993 |

OTHER PUBLICATIONS

Examination Report issued in related Taiwan Application No. 104305390 dated Mar. 11, 2016 and English translation of the same (6 pages).

Notification of Transmittal of the International Search Report and the Written Opinion of the International Searching Authority, of the Declaration from the International Bureau of WIPO for International Application No. PCT/US2016/019905 dated May 5, 2016, 7 pages.

* cited by examiner

BEVERAGE CONTAINER

CROSS-REFERENCE TO RELATED APPLICATION

The application claims the benefit of U.S. Provisional Patent Application No. 62/121,607, filed Feb. 27, 2015, which is hereby incorporated by reference in its entirety.

FIELD

The invention relates to a beverage container and, more particularly, to an improved container for receiving, storing, and transporting fluids, such as coffee.

BACKGROUND

Erectable beverage containers for storing and transporting bulk amounts of beverages, and particularly hot beverages such as coffee, hot chocolate, or hot water for tea, are well known. Such containers are typically made out of a single sheet of creased cardboard and include an insulated flexible bladder with a spout for receiving and holding a liquid. The containers generally have a front wall from which the spout extends, a pair of opposite side walls, a rear wall opposite from the front wall, a top including a handle, and a bottom. Examples of such containers can be found in U.S. Pat. Nos. 7,077,309 and 8,627,999. Details regarding the manufacturing and assembly of such containers are disclosed in U.S. Pat. No. 7,066,869, which is incorporated herein by reference in its entirety. Such containers are designed to be manufactured in a partially assembled state wherein the container is shipped from the factory in a collapsed state, to be erected by a user immediately before filling the container with a liquid.

Known erectable beverage containers have a front wall that includes an opening through which the spout of the flexible bladder protrudes and in which the spout is captured. This front wall extends generally perpendicularly with respect to the flat bottom surface, such that when the beverage container is rested on a flat surface, the front wall extends vertically upward at a 90 degree angle from the surface. The spout defines an opening and a passage into the bladder having a longitudinal axis that extends perpendicularly with respect to the outer surface of the front wall. With these types of containers, the spout extends horizontally from the vertical front wall. Such containers are designed to be filled in one position and transported or stored in another position. Accordingly, it is virtually impossible to fill the beverage container with a liquid when the container is resting on its bottom surface without a specially designed funnel or other equipment. Thus, the beverage container is filled with the container resting on a rear wall opposite from the front wall, or is otherwise held such that the spout extends generally upwardly to receive a fluid poured into the spout from above. After the desired amount of fluid is poured into the bladder within the container, a cap is attached or screwed onto the spout, and the container may then be rotated and rested on its bottom surface in a transport orientation with the handle extending upwardly. However, if the filled container is rotated back into its normal storage and transport orientation with the spout extending horizontally before the cap is attached to the spout, the liquid will shift around inside the container and may be expelled from the spout. As the fluid inside the container may be extremely hot, any liquid expelled unexpectedly from the spout is undesirable, especially if it comes into contact with the person manipulating the container and at the very least will cause a mess and potentially a slip hazard.

Because the beverage container needs to be rested or held with the spout opening extending vertically while being filled, the container and bladder size must be such that when the container is tilted back to its normal resting position, the level of the liquid inside the container is below the spout opening. Otherwise, as described above, liquid will spill out of the spout when the container is rotated back into its transport position, or if the cap has been secured to the spout before shifting the container back into the transport position, liquid will spill out when the cap is first removed by a user. In most cases, the person filling the container will be different from the person opening the container and therefore in most cases it would be difficult to know that the container is overfilled and will expel liquid upon opening. Obviously, such a condition is undesirable, and therefore known beverage containers are designed and configured to make it difficult or impossible to overfill in this manner. For example, the bladder is sized relative to the container such that when the container is in the fill position (i.e., resting on its rear wall), liquid may be filled up to the spout opening, but when the container is tilted back into the transport orientation (i.e., resting on its bottom wall), the bladder will shift positions within the container to rest on the bottom of the container with the level of fluid in the bladder assuming a position below the opening in the spout. With this design constraint, the spout of the bladder must be sufficiently high above the bottom of the container to keep liquid from being expelled when the container is shifted between the filling and transporting orientations. This results in the requirement that the volume of the container is sufficiently larger than that of the bladder. Thus, even when the bladder is filled to capacity, a relatively high percentage (approximately 50%) of the volume of the container is empty. Unoccupied interior space in the beverage container results in material waste and increased manufacturing expenses. In addition, the container and bladder are sized such that the bladder has a large degree of freedom of movement within the container walls and can shift within the container unexpectedly, which can result in unexpected spillage, unpredictable pouring dynamics, and a decrease in the overall stability of the container.

Known beverage containers of the type described above are generally sized to hold numerous cups of liquid, and in some forms, between 96 to 128 ounces of liquid, weighing approximately six to nine pounds. Accordingly, a user will normally pour liquid from the beverage container into smaller vessels, such as a cup or mug, for consumption. Due to factors associated with the shape, size, and spout location of known containers, as well as the weight of a filled container, it can be relatively difficult to control the pouring of a liquid from known beverage containers with a high degree of accuracy, particularly when the container is full. For example, a user can grip the container by the handle and tilt the container until the liquid begins to pour from the spout into a cup placed or held below the spout. The spout generally will be pointing away from the user, or at least transversely with respect to a user's line of sight, in order to reduce the likelihood of spilling any liquid on the user. Because the spout extends horizontally from the vertical front wall, it can be difficult for a user to accurately pour a liquid into a smaller container. This is because as the container is tilted forward, the entire spout, or a substantial part of it, including the opening formed thereby is obscured by the sidewalls or top of the container and thus lies out of the line of sight of the user. If a user cannot see at least a portion of the spout, it is difficult to determine whether liquid is pouring from the spout, as well as the amount of liquid and the velocity with which it is being poured. The result can be spilling liquid or overfilling the smaller vessel.

Another disadvantage of a beverage container with a horizontally extending spout is that they are more prone to spilling and dripping. For example, if a container is transported or moved around without a cap on the spout, any liquid that sloshes around up to the level of the spout can also continue out of the spout. Further, after pouring liquid from the container and setting the container down, any liquid remaining in the spout may continue to flow out of the spout, rather than falling back into the bladder.

Another issue with known beverage containers is known as "turtling," i.e., the propensity for the spout to be pulled partially or entirely into the container interior. This condition may occur as the bladder begins to fill and the weight of the liquid may not be entirely supported by the walls, such as the rear wall during filling or the base when the container is in the transport orientation. Turtling may also occur when the base wall of the container flexes or sags from the weight of the liquid during transport of the container. Rearward or downward wall movement allows the bladder to move in the same direction, thereby pulling the spout in the direction of movement and possibly causing the spout to be pulled into the container interior or causing the spout to be cocked to one side. The forces on the spout may also put strain on the front wall through which the spout extends. The problem can be compounded if the front wall gets wet and loses physical integrity, potentially causing structural failure of the front wall.

U.S. Patent Publication No. 2005/0211754 to Fulcher discloses a beverage container with a sloped front wall portion. The sloped wall portion positions the spout generally at a 45 degree angle from the horizontal rather than perpendicular thereto as with typical beverage containers. However, the design of the container has numerous drawbacks. For example, Fulcher discloses that a separate add-on handle (127) may be connected to the top of the container. The separate handle component must be attached to the container after final hand assembly of the container as shown in FIGS. 6(E)-6(H). As Fulcher describes, the add-on handle is designed to hold the top flaps of the container together. If a user were to omit attaching the handle, the container top would be unsecured and prone to opening, particularly while pouring a liquid therefrom. Further, without the handle to connect the various flaps (120-123) together, the risk of "turtling", i.e. the spout of the beverage bag being pulled into the interior of the container is particularly acute. Without the handle being provided, there is nothing to prevent the inside top flap (123) from being pulled downwardly into the container interior by the weight of the liquid in the beverage bag. Thus, the only flap keeping the spout from being pulled into the interior of the container is the outside top flap 120, which is also unsecured without the handle in place. When a handle is not provided, the side panels of the shell also become more susceptible to bulging due to the unsecured and movable top flap failing to contain an outward expansion of the side panels upon the beverage bag being filled. As the side panels are pushed outwardly, more of the weight of the liquid is supported by the spout, causing a tendency for the spout to be pulled into the container. Moreover, if the top handle component is not provided to retain the top flaps (120-123) together, bulging of the sides panels is even more likely to occur and because the top wall panels (120, 123) are not secured on one their ends, the bulging of the side panels will no longer provide support to the top panels, allowing them to collapse inwardly.

Due to the flexibility of the plastic add-on handle and because the handle is attached to the container top via slots in the top flaps thereof, the ability to control the pouring of the liquid is also diminished since the handle ends are unsecured and can move, even during pouring. Fulcher discloses providing a back handle (153) in the form of a fold-in flap on the rear panel (150) to allow a user to hold the container at an additional or alternative location while pouring. However, a user may wish to hold the drinking vessel or cup while the vessel is being filled by the beverage container to prevent the vessel from shifting as it receives liquid from the beverage container. Accordingly, a beverage container that requires two-handed pouring can be disadvantageous in such instances. And using only the flexible plastic add-on handle or the back handle alone is disadvantageous when pouring liquid from the Fulcher container such as when the beverage bag is filled to capacity or near capacity and thus is heavier.

Another shortcoming of the Fulcher container is that it is inefficient to assemble. In particular, the upper flaps (120-123) are configured such that the beverage bag must be inserted into the inside nozzle hole (136) in flap (123) by hand after the container shell has been folded and glued to form a collapsed shell as shown in FIG. 6D. This is because the spout must first be inserted into inside nozzle hole (136) and then slid into the relatively narrower portion thereof to lock the spout in place. Then, the spout must be inserted through the outer nozzle hole (135) in the front sloped panel (120), as is evident from the configuration of the flaps shown in FIGS. 6(E)-6(G), in which the inside top flap (123) is folded under the outside top flap (120). Thus, both the handle (127) and the beverage bag must be attached to the container by hand, making the container inefficient to assemble and produce in large quantities.

SUMMARY

In one form, an erectable beverage container includes a container body formed from a single unitary blank configured to be erected from a collapsed orientation into an expanded orientation for receiving, transporting, and pouring a liquid. The container body in the expanded orientation has a flat base, a top, and a front wall, a rear wall, and opposing side walls extending between the container top and base cooperating to form an interior space. The container includes a flexible bladder having an interior for storing liquid therein. The bladder is disposed in the container body interior space and includes a spout having an opening in communication with the bladder interior to provide a liquid passageway thereto. The container body top includes a first inclined portion oriented obliquely relative to the flat base extending upwardly from the rear wall to an apex. A handle portion of the container body extends from the first inclined portion for transporting and manipulating the container. A second inclined portion of the container body top includes an inclined wall portion oriented obliquely relative to the flat base extending upwardly from the front wall to the apex. The inclined wall portion includes an aperture through which the spout extends. In one form, the bladder is attached to an inner surface of the inclined wall portion with an adhesive. In one preferred embodiment, the apex of the container is spaced from the base by less than 7 inches to provide a container that may be filled directly underneath the dispensing spout of most brewing machines.

In some forms, the front wall extends obliquely from the base. In other forms, at least one of the opposing side walls and the rear wall of the container body extends from the base at an obtuse angle with respect thereto. In another form, the second inclined portion may be oriented at an angle between 55 and 85 degrees with respect to a vertical axis perpendicular to the flat base. In another form, the second inclined portion is oriented at an angle between 5 to 35 degrees with respect to a vertical axis perpendicular to the flat base. In yet another form, the first inclined portion is oriented at first predetermined acute angle with respect to a vertical axis perpendicular to the flat base, and the second inclined portion is oriented at a second predetermined acute angle with respect to a vertical axis perpendicular to the flat base, and the first predetermined acute angle is larger than the second predetermined acute angle. According to one approach, the first and second inclined portions are each oriented at an angle with respect to a vertical axis perpendicular to the flat base, and the angle of the second inclined portion is smaller than the angle of the first inclined portion. According to another approach, the first and second inclined portions each has a length extending therealong toward the apex, and the length of the first inclined portion is greater than the length of the second inclined portion. Also, in some forms, the apex will be located closer to the front of the container than the rear. The dual inclined top of the beverage containers disclosed herein provide improved ergonomic benefits, in particular more comfortable wrist, elbow, and shoulder positioning when pouring liquid from the container, while also providing numerous other performance and manufacturing benefits, as will be described in greater detail herein.

The top of the container body may include a rearward top flap extending from the rear wall that forms part of the first inclined portion and a spout locking flap that extends from the rearward top flap and forms part of the second inclined portion. The spout locking flap overlies the second inclined wall portion and includes a spout engaging portion that is configured to extend about at least a portion of the spout to keep the spout from being pulled into the interior space through the aperture. In one form, the first and second inclined portions intersect at the apex at an angle of between 90 and 135 degrees. According to one approach, the apex of the container body top extends linearly between the opposing side walls and is cooperatively formed by an edge between the inclined wall portion and a forward top flap extending from the inclined wall portion, and an edge between the rearward top flap and the spout locking flap that overlies the edge between the inclined wall portion and the forward top flap. Accordingly, the apex is cooperatively formed by multiple flaps. In other forms, the apex could be formed by a fold line in a single top flap, or the meeting point of two or more separate inclined top portions. Optionally, the handle portion includes a notch for receiving a portion of each of the rearward and forward top flaps for securing the top flaps therein.

The container may be provided with a support shoulder tab or flap that extends from each of the opposing side walls. Each support shoulder tab is configured to extend along an interior surface of the inclined wall portion to provide support thereto.

According to another approach, a collapsible beverage container blank formed from a unitary sheet of material includes a front wall having an upper edge with a top wall portion extending therefrom. The top wall portion includes an aperture for receiving a spout therein, and an upper edge with a forward top flap extending therefrom. The blank further includes a first side wall having an upper edge with a first top flap extending therefrom, a first handle flap extending from the first top flap, a rear wall having an upper edge with a rearward top flap extending therefrom, a second side wall having an upper edge with a second top flap extending therefrom, and a second handle flap extending from the second top flap. The forward and rearward top flaps each include an elongate slot for receiving the first and second handle flaps therethrough. The top wall portion and the forward, rearward, first, and second top flaps are configured to form a beverage container top having first and second inclined portions that meet at an apex spaced from the front wall when the beverage container blank is assembled into an expanded configuration. The top wall portion forms the second inclined portion and the forward, rearward, first, and second top flaps form the first inclined portion with the first and second handle flaps extending from the second inclined portion in an upright orientation. In one form, the first and second handle flaps each comprise a notch therein that are aligned together for receiving a portion of the forward and rearward top flaps therein when the beverage container blank is in the expanded configuration. In some embodiments, the first and second handle flaps taper down between outer and inner surface portions thereof from a rearward portion to a forward portion thereof to provide an ergonomic advantage, thereby making it easier for a user to pour liquid from the container.

The beverage container blank may be provided with shoulder flaps that extend from each of the first and second side walls. The shoulder flaps are configured to engage with an inner surface of the top wall portion in the expanded configuration of the beverage container blank for providing support to the top wall portion and prevent downward deflection of the top wall portion. In one form, the front wall includes a pair of side edges extending from a bottom edge thereof that diverge apart from one another as the side edges extend upwardly towards the upper edge of the front wall. In this form, the front wall is wider at the upper edge than at the bottom edge.

The beverage container blank may include a spout locking flap extending from the rearward top flap that is configured to lay over the top wall portion with the beverage container blank in the expanded configuration. The spout locking flap includes a spout engaging portion configured to extend about at least a portion of a spout extending through the aperture in the top wall portion. The blank may be provided with a flexible bladder having spout for receiving fluid therein with the spout received in the aperture in the top wall portion.

DETAILED DESCRIPTION OF THE PREFERRED EMBODIMENTS

The exemplary embodiments below describe a beverage container for storing and dispensing liquids. Generally, the beverage container includes an outer container or shell and an inner bladder or bag. The outer container includes right, left, front, and rear walls, and a top and bottom that define an interior space for placement of a beverage bladder that includes a spout for providing a fluid passageway into the bladder. Advantageously, the embodiments are configured such that the top of the container has first and second inclined portions that meet at an apex. An integral handle extends from the first inclined portion and the spout extends from the second inclined portion. The handle is configured to allow a user to dispense from the beverage container using one hand, thereby freeing the other hand for grasping the drinking vessel while filling. The spout is oriented so that its axis extends obliquely to a vertical reference axis. The handle may have a configuration which orients the handle at an incline similar to the first inclined portion, or it may have a different orientation. In addition, the handle may have a tapered shape to make pouring a liquid from the container more ergonomic. The spout does not extend horizontally or vertically but rather is oriented at an incline extending in a generally non-vertical, upward direction to allow filling of the container directly under a dispensing spigot of a commercial beverage machine. In one form, the bottom of the container may be oriented horizontally during filling, such as while the container base or bottom wall is resting on a flat surface. In another form, where the vertical upward component of the spout is relatively small, the container can be filled directly under the dispensing spigot but the orientation of the spout will require the container to be shifted onto its rear wall prior to filling. The inclined orientation of the spout and the handle allows for improved ergonomic and pouring capabilities by allowing the user to more comfortably tilt the container to pour liquid from the spout, and also allow the user to easily see the spout while pouring to see fluid being dispensed from the spout as the container is tilted from its fill orientation as described above. Such forms provide numerous other benefits, including the capability to be inserted and filled under any commercial beverage machine dispensing spigot, material reduction, improved stability so as to reduce the potential for tipping, improved pouring dynamics associated with greater compactness and a lower center of gravity, and the reduction of drips from the spout after pouring. Other advantages will be apparent upon further reading of the following description of the embodiments.

Figure 1:
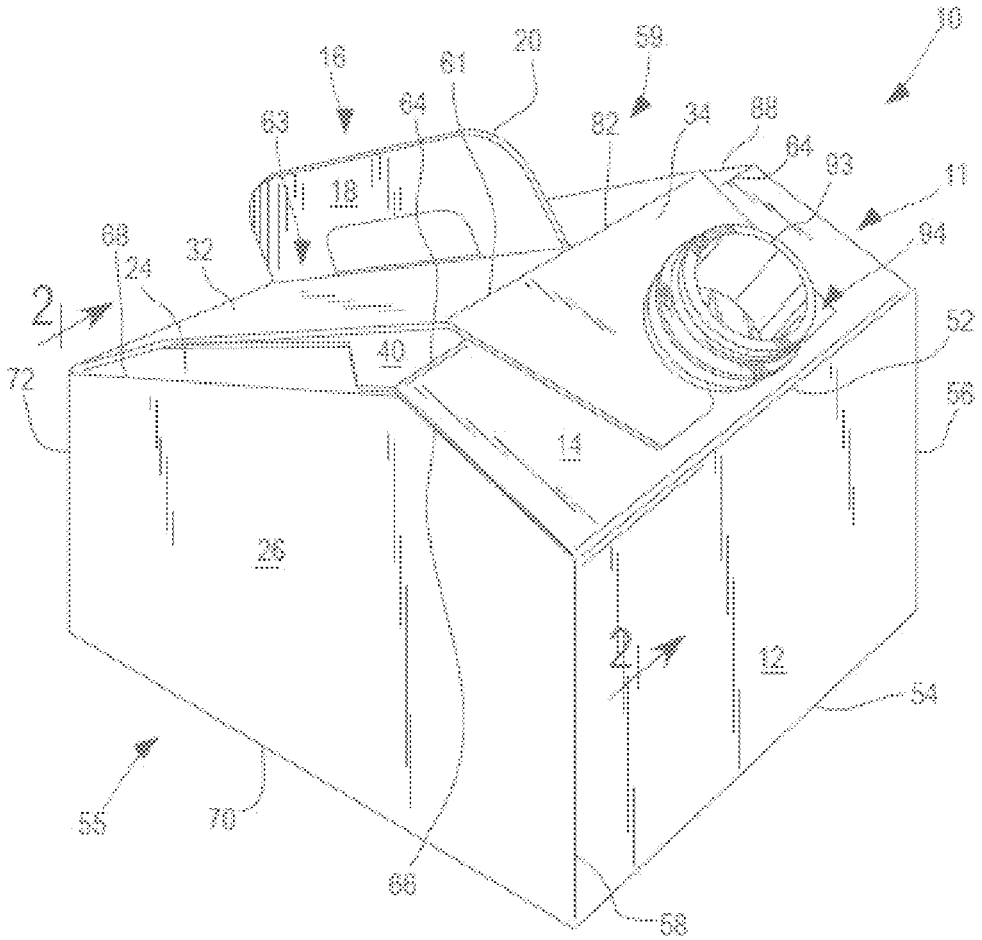
FIG. 1 is a perspective view of a beverage container showing an upper, inclined forward portion of the container body having a spout extending generally orthogonally therefrom.
Figure 2:
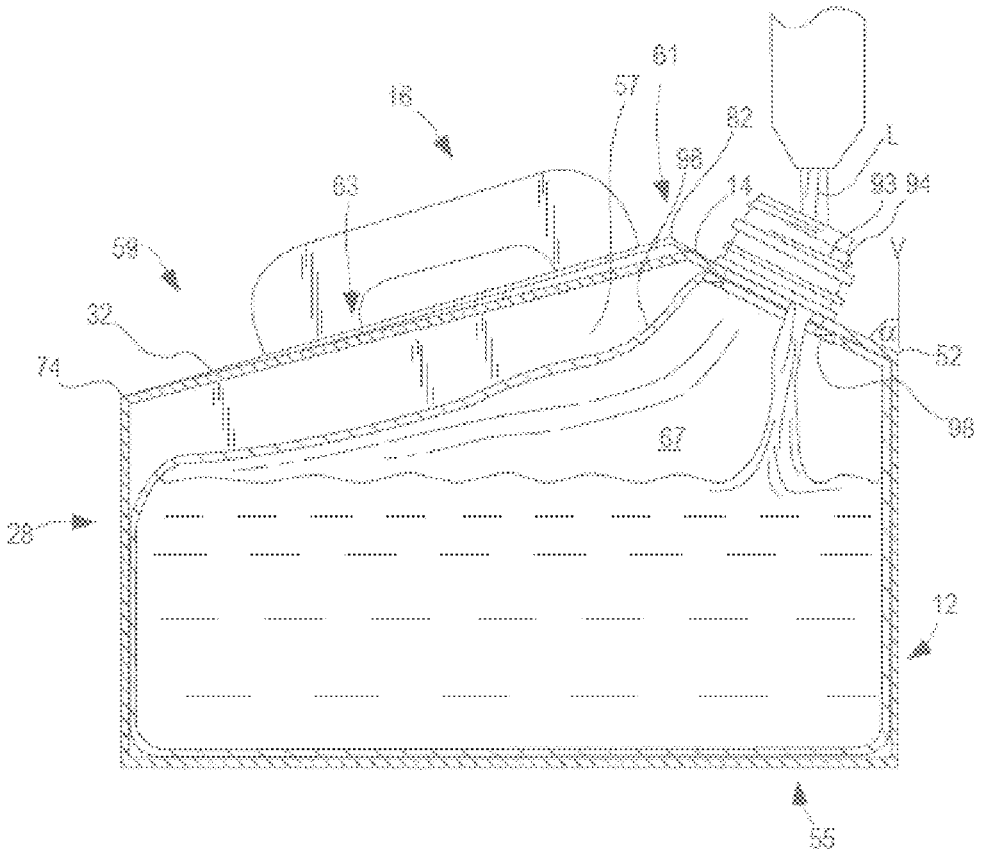
FIG. 2 is a cross-sectional side view of the container of FIG. 1 showing a liquid being poured into the spout of the container.
Figure 3:
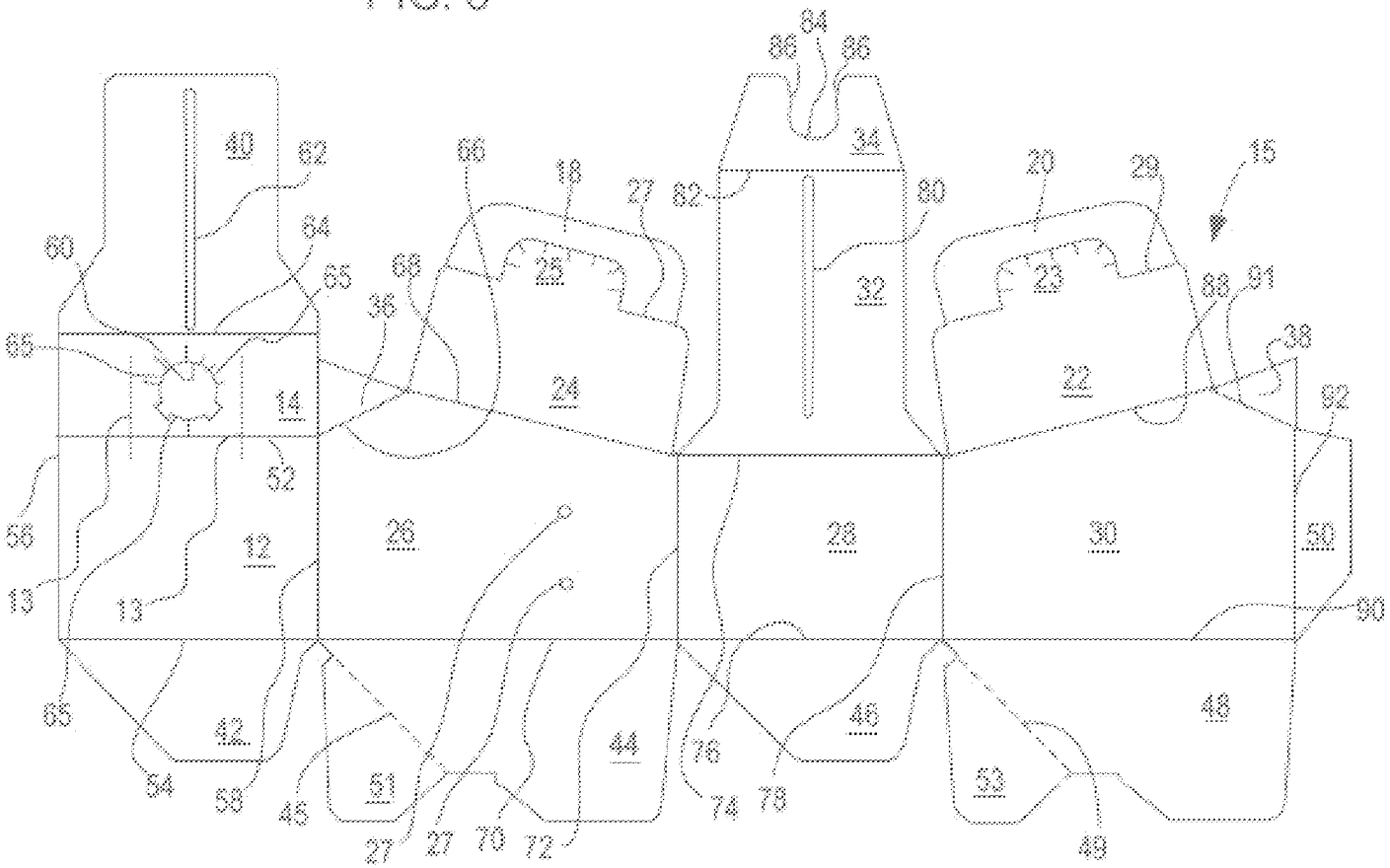
FIG. 3 is a top plan view of a blank from which the container of FIG. 1 is constructed.

FIG. 1 illustrates a perspective view of a beverage container 10, hereinafter referred to as the container 10. As shown in FIGS. 1-3, the container 10 includes a container body formed by an outer shell 11 including a front wall 12, a left sidewall 30, a right sidewall 26 and a rear wall 28 interconnected by fold lines or living hinges. The front wall 12 is hingedly attached along a right front fold line 58 to the right sidewall 26. The right sidewall 26 in turn is hingedly attached along a right rear fold line 72 to the rear wall 28. The rear wall 28 is hingedly attached along a left rear fold line 78 to the left sidewall 30. An attachment tab 50 is hingedly attached to the left sidewall 30 along a left front fold line 92. Adhesive is applied to the opposite (outer) side of the attachment tab 50 for securing the tab 50 to the inside surface of the front wall 12. Each of the walls 12, 26, 28, 30 extend perpendicularly from the rectangular base 55 so as to have a vertical, upright configuration. The front and rear walls 12, 28, have rectangular configurations, while the right and left sidewalls 26, 30 have a pentagonal or 5-sided configuration. The base 55 of the container 10 has a generally flat configuration for stably resting on a flat surface, such as a table. The top 59 of the container 10 has a first inclined portion 63 extending between fold lines 68, 88, which increases in elevation from the rear top fold line 74 to the apex of the container 61. Handle 16 extends upwardly from this first inclined portion 63 to provide for an ergonomic grip that improves a user's control over the container when the container 10 is tilted by the user to pour liquid from the spout. A second inclined forward portion in the form of inclined transition wall portion 14 extends between the front wall 12 and the first inclined portion 63 of the container top 59, the two inclined portions meeting at the apex 61. In one preferred form, the first and second inclined portions meet at an angle of between 90 and 135 degrees. In one preferred form, the second inclined portion has a length that is shorter than the first inclined portion. In addition, the apex of the container is preferably closer to the front wall of the container than the rear wall, which allows for provision of a relatively longer handle which gives a user greater control when transporting the container and tilting the container for pouring liquid therefrom.

As shown in FIG. 3, the outer shell 11 is formed from a single unitary blank 15, preferably of corrugated paperboard or cardboard paperboard. The inner surface of the blank 15 is shown in FIG. 3, with the opposite, outer surface being on the other side. The blank 15 includes a series of top and bottom flaps for forming the top and bottom of the container 10. In general, all of the top flaps remain in the open, unfolded configuration until the container is fully erected from a flat, collapsed orientation for shipping and assembled by a user for introducing a liquid into the container. The blank 15 includes a top right flap 24 and a top left flap 22 that extend from a top edge 68 of the right sidewall 26 and a top edge 88 of the left sidewall 30, respectively. The top right and left flaps 24, 22 further include right and left handle flaps 18 and 20, respectively, that are hingedly connected thereto via fold lines 27 and 29. Right and left tab portions 25, 23 extend from the top right and top left flaps 24, 22 respectively. When the right and left handle flaps 18, 20 are folded about fold lines 27 and 29, the right and left tab portions 25, 23 remain in the same plane as the top right and top left flaps 24, 22, respectively, providing handle openings through which a user's fingers may be inserted to grip the handle flaps 18, 20. When the container 10 is assembled for filling with a beverage, the handle flaps 18, 20 are folded into an upright configuration with the right and left tab portions 25, 23 overlapping one another and extending through the openings formed by the opposite handle flaps 20, 18 and the inner surfaces of the handle flaps 18, 20 are brought into engagement with each other to form a rigid handle 16 that enables one-handed carrying of the container 10, as well as one-handed pouring.

The container top 59 is further formed by forward top and rearward top flaps 40 and 32 that extend from a top edge 64 of the inclined wall portion 14 and top edge 74 of the rear wall 28, respectively. A spout locking flap 34 is hingedly connected along fold line 82 to the rear top flap 32. The spout locking flap 34 includes opposite finger portions 86 spaced apart by an arcuate portion 84 sized to fit around at least a portion of the spout 94 to keep the spout from being pulled through the aperture 60 and into the interior 57 of the erected container 10. The finger and arcuate portions extend approximately 270° around the spout. The finger portions 86 are preferably sized and configured to provide an interference fit with the outer perimeter of the spout 94 for securing the flap 34 to the spout. The forward top and rearward top flaps 40, 32 are configured to be folded in an inward direction toward one another over the top of the container 10 for securing the container in the fully assembled configuration. As shown in FIG. 3, each flap member 40 and 32 defines a respective slot 62, 80 through which the handle members 18, 20 extend when the top right and left flaps 24, 22 are folded inwardly over the top of the container 10 and the handle members 18, 20 are folded so as to extend vertically upward in a side-by-side arrangement. The front top flap 40 is first folded over the top right and left flaps 24, 22 and the handle flaps 18, 20 are inserted from below through the slot 62. The rear top flap 32 is then folded over the front top flap 40 and the vertically extending handle flaps 18, 20 are inserted through slot 80, such that the rear top flap 32 rests flat against the outer surface of the front top flap 40. The spout locking flap 34 may then be positioned about the spout 94 as shown in FIG. 1 with the spout locking flap 34 laying over the inclined wall portion 14.

The container top 59 advantageously has its apex 61 spaced rearwardly from the front wall 12. In this form, the spout locking flap fold line 82 is also spaced rearwardly from the front wall 12 and specifically the top edge 52 of the front wall, which allows the rear top flap 32 to be reduced in length over corresponding top flaps in prior containers. Similarly, front top flap fold line 64 is spaced rearwardly from the front wall 12 and top edge 52 thereof, allowing for a similar reduction in length of the front top flap 40, corresponding with a beneficial reduction in material for the container 10 herein. This is due to the presence of the forward inclined wall portion 14 for the spout 94, as will be described further hereafter.

The bottom or base 55 of the container 10 is formed by a plurality of bottom flaps, including front bottom flap 42, which is hingedly connected along fold line 54 to the front wall 12. Right bottom flap 44 is hingedly connected to right sidewall 26 along fold line 70. Rear bottom flap 46 is hingedly connected to the rear wall 28 along fold line 76, and left bottom flap 48 is hingedly connected to the left sidewall 30 along fold line 90. Flap portion 51 is hingedly connected to right bottom flap 44 along a perforated fold line 45, and similarly flap portion 53 is hingedly connected to left bottom flap 48 along perforated fold line 49. During initial assembly of the collapsed container, flap portions 51, 53 are adhesively connected to the outer surfaces of front bottom flap 42 and rear bottom flap 46, respectively, via an adhesive, such as a cold set adhesive applied to either the glue flaps 51, 53 or the front and rear bottom flaps 42, 46. Advantageously, after the bottom flaps are glued together, the bottom flaps are folded inwardly with the inner surfaces of the flaps laying against the inner surfaces of the walls 12, 26, 28, 30. The bottom flaps 42, 44, 46, 48 are constructed such that they may be easily shifted from this folded configuration with the container 10 in a collapsed orientation, to a generally flat configuration to form the base 55 when the container is expanded by a user into its fill orientation, as is known in the art.

The respective container walls, top flaps, and bottom flaps form a closed interior space 57 therebetween in which the beverage bladder 96 resides, as shown in FIG. 2. In one form, a liquid may be poured directly into the spout 94 from above the spout with the container 10 resting on a horizontal surface. Advantageously, this allows the container, and specifically the bladder 96 herein, to be filled and transported in the same orientation, i.e., it is unnecessary to shift the container onto its rear wall 28 in order to fill the container.

In one form for providing a container that can be transported and filled in the same orientation, the container 10 advantageously includes a forward inclined wall portion 14 that extends from the top edge 52 of the front wall 12. The inclined wall portion 14 has an aperture 60 through which a portion of the spout 94 of the bladder 96 extends. The aperture 60 includes a plurality of radial slits to form a plurality of tabs 65 around the aperture 60 for engaging with the outer perimeter of the spout 94 with an interference fit, while avoiding tearing of the material around the aperture 60 when the spout 94 is inserted therethrough due to deflection of the tabs 65. The spout 94 is provided with one or more annular ring projections around its perimeter that engage with the opening tabs 65 and the spout locking flap 34 for keeping the spout 94 from being pulled through the aperture 60 into the container interior 57 and from moving or becoming cocked to one side. In addition, the spout 94 has a helical thread extending about its outer perimeter distal of the ring projections for engaging with a threaded cap.

Figure 2A:
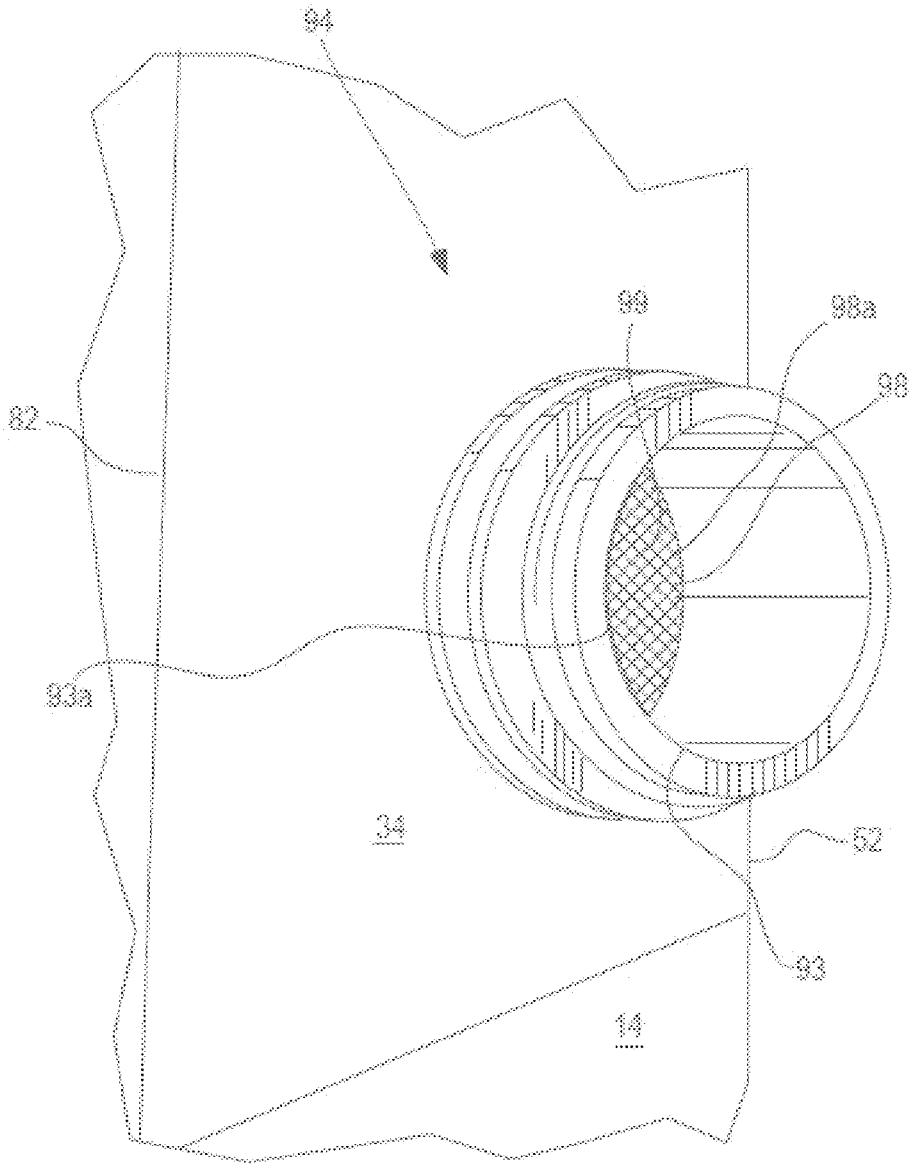
FIG. 2A is an enlarged top view of the spout of the container of FIG. 1 from a perspective directly above the spout.

As shown in FIG. 2, when the container is fully assembled, the aperture 60 lies over the interior of the container, so that liquid may be poured directly from above the spout 94, such as by a dispensing spigot, through a fluid passageway between outer and inner openings 93, 98 of the spout and into the internal space 67 of the bladder 94 with the container base 55 oriented horizontally. Further, the inclined spout orientation allows a user to have a direct line of sight into the interior of bladder 96 during the filling process without needing to reorient the container 10. If a user has a direct line of sight into the internal bladder 96 from vertically above the spout 94, the user can be assured that a liquid may be poured from above the spout directly into the container 10. From this "spigot" perspective above the spout shown in FIG. 2A, the vertical opening or passage 99 (shown with cross-hatching) will be defined on one side by a lower arc portion 98*a* of the inner spout opening 98 and on the other side by upper arc portion 93*a* of the outer spout opening 93. Even though the spout openings 93, 98 have circular configurations with the same radii, because the spout 94 is inclined with respect to a user's viewpoint from above, the vertical passage 99 will appear to be defined by two intersecting arc portions 93*a*, 98*a* having different radii.

The inclined wall portion 14, aperture 60, and the outer spout opening 93 are each oriented in planes oriented at an angle α with respect to vertical (i.e. axis V extending perpendicularly from the base), such that the spout body 94, which extends generally perpendicularly from the inclined wall portion 14 at a complimentary angle to a, is oriented at least partially vertically upwardly. In other words, a longitudinal axis L about which the spout 94 extends is inclined with respect to a horizontal plane coextensive with the flat base 55. The inclined wall portion 14, and similarly the aperture 60, and the opening of the spout 93, all having the same angle of inclination, may be oriented at a variety of angles of inclination, but preferably the inclined wall portion 14 will be disposed at an angle of inclination that will provide a sufficient horizontal component such that liquid may be poured directly into the container while the base 55 is horizontal. A preferred range of inclination of the inclined wall portion is from 10 to 80 degrees, and more preferably between 40 and 80 degrees. In other forms, the inclined wall portion may be inclined at an angle between 55 and 85 degrees from vertical, which is particularly suitable for embodiments having a low profile orientation for being filled directly beneath a brewer dispensing spigot as shown in FIG. 2. With this configuration, the container may be filled and transported in the same orientation, eliminating any potential spillage related to containers that are filled and transported in different orientations. In other forms, the inclined wall portion 14 may have a relatively smaller horizontal component such that liquid may not be poured (without excessive care) directly into the container while the base 55 is horizontal, or may require that the container body be repositioned in order to position the spout 94 under the dispensing spigot for filling. In this form, the inclined wall portion may be inclined at an angle between 5 and 35 degrees, which is particularly suitable for containers that are designed to be filled and transported in different orientations. Regardless of whether the inclined wall portion permits filling of the container in the transport orientation thereof, other benefits, such as reduced spillage when transporting the container without a cap and improved visibility of the spout during pouring will still be realized. Further, the inclined wall portion allows for a shorter rearward top flap 32, resulting in a reduction of material needed to form the container 10.

As indicated in FIG. 3, a hot melt adhesive is applied at adhesive locations 13 on either side of the aperture 60 for bonding the bladder 96 to the inclined wall portion 14 and front wall 12. Because the bladder 96 is adhesively attached to interior surface of the inclined wall portion 14 and the spout 94 is captured within the aperture 60 in the inclined wall portion 14, any weight of the liquid that is not supported by the base 55 of the container 10 will be directly supported by the inclined wall portion 14 and indirectly by the surrounding walls. Accordingly, the right and left sidewalls 26, 30 may be provided with support shoulder tabs 36, 38 to provide additional support to the inclined wall portion 14. The support shoulder tabs 36, 38 have a triangular shape and are hingedly connected to the respective right and left sidewalls 26, 30 along fold lines 66, 91. The fold lines 66, 91 follow the same incline as the inclined wall portion 14 when the container is assembled as shown in FIG. 1. During assembly, the support tabs 36, 38 are folded underneath the inclined wall portion 14 and are disposed against the inner surface thereof, such that when liquid is poured into the container 10, the support shoulder tabs 36, 38 provide additional support to the inclined wall portion 14 to keep the inclined wall portion 14 from being pulled inwardly into the interior of the container 57 by the liquid in the bladder. In other forms, the support tabs 36, 38 could be omitted.

Preferably, an adhesive, such as a fugitive hot melt adhesive, is applied to the inner surface of the right sidewall 26 at one or more adhesive locations 27 for temporarily fixing the bladder 96 to the sidewall 26. This adhesive helps to hold the bladder 96 in place during manufacturing, but its primary purpose is to help open the bladder 96 from its flat or flattened configuration to a filling configuration where the side walls are pulled apart. Because the bladder 96 is made from planar sheets of material that are heat sealed together around their perimeter, the bladder tends to remain in a flattened shape until acted upon by outside forces or until a fluid is introduced into the bladder 96. Further, due to the materials used and the manufacturing process, static forces may hold the side walls of the bladder together and resist the expansion of the bladder 96. However, in its flattened state, the bladder 96 can be difficult to fill as a result of the bladder side walls sticking together, which may at least initially cause overflowing of liquid from the spout 94 if the walls are not at least partially separated around the spout or do not quickly separate during filling of the bladder. Accordingly, the adhesive at adhesive locations 27 are configured to provide a temporary and releasable bond between the sidewall 26 and the bladder 96 that releases when the container 10 is shifted from its collapsed, flat orientation to a fully expanded orientation. Just prior to expansion of the container, the front wall 12 and left sidewall 30 lay flat against the right sidewall 26 and rear wall 28, with the bladder 96 sandwiched therebetween. As the sidewalls are expanded apart to the erected, filling orientation, as shown in FIG. 2, the adhesive at adhesive locations 27, pulls the sides of the bladder 96 apart. Other adhesive locations could be utilized in other forms.

As discussed above, a hot-melt adhesive is applied along one or both sides of the aperture 60 at adhesive locations 13 during manufacturing of the container 10 to permanently bond the bladder 96 to the front wall 12 and transition wall portion 14. This adhesive keeps the spout 94 from being pulled into the interior of the container when the container is initially erected into the filling orientation. The adhesive also serves to pull the bladder sidewalls apart in the areas immediately surrounding the spout 94, thereby preventing the sides of the bladder from sticking together as mentioned above. Forcing the bladder sides to remain in a separated and open position near the spout, in conjunction with the sidewall separation caused by the releasable adhesive, ensures that the bladder is fully ready for filling. Accordingly, the bladder 96 is permanently attached to the front wall 12 and the inclined transition wall portion 14 near the spout, while the opposite end of the bladder 96 is temporarily attached to the right sidewall 26 at adhesive locations 27. As the container 10 is opened from the collapsed orientation by pushing the front right edge and the rear left edge of the container toward one another, the sides of the bladder 96 are simultaneously pulled apart at the adhesive locations 13 and 27. The sudden expansion of the interior space 67 of the bladder 96 creates a temporary vacuum therein, which draws in air into the bladder through the spout, thereby allowing the bladder to remain partially open for continuous and controlled filling of the bladder. As the container 10 is fully opened, the adhesive at locations 27, due to its low-tack property, will release the bladder 96 from the right sidewall 26, so that the bladder is only adhesively attached to the inclined wall portion 14 and the front wall 12. Without the provision of the adhesive locations as described, it has been found that the bladder sidewalls will remain attached to each other and the bladder will only accept a small amount of liquid at a time, requiring the person filling the bladder to either wait for the liquid to eventually drain further into the unopened and remaining portion of the bladder or shake the container to expedite movement of the portion of dispensed liquid into distal end of the bladder. In either situation, the bladder will take an inordinate amount of time and patience to completely fill since it must be filled in increments. In some forms, the bladder 96 may be attached solely to the inclined wall portion 14 or the front wall 12.

Numerous other advantages attain from a container having an inclined wall portion with an upwardly oriented spout 94. One advantage is that the height of the container may be significantly reduced compared to known erectable beverage containers. A lower container height eliminates the concern for spilling the contents of the container when the container is shifted from a filling orientation to a transporting orientation. This concern required the height of the spout to be sufficiently high to avoid spillage due to the liquid level in the bladder being too close to the spout opening when the bladder is shifted from the filling orientation to the transporting orientation. In a currently preferred form, the container 10 has assembled dimensions of approximately 9 inches long by 6.5 inches wide by 6.5 inches tall at the apex 61. In comparison, prior known container 310 has assembled dimensions of approximately 9 inches long by 6.5 inches wide by 8.5 inches tall at its apex. In one form, the apex is preferably less than 7 inches tall as measured from the base of the container. This low-profile design allows the container to fit underneath most coffee brewers to allow the container to be filled directly underneath the brewer instead of first filling an intermediate vessel or urn, and then transferring that vessel's contents into the beverage container. Despite the smaller height size of container 10, it advantageously has the same fluid capacity as the prior known container design, despite a decrease in internal volume of approximately 20 percent. Of course, the container having an inclined forward wall portion may take a variety of shapes and sizes, as would be apparent to one or ordinary skill. But by removing the need to shift the container between different filling and transporting orientations, the height of the container may be reduced substantially.

Reducing the height of the container provides numerous advantages in efficiency. First, less material is needed. With respect to the embodiment disclosed in FIGS. 1-4, Applicant observed a reduction of height of the blank of approximately 3.8 inches compared with the prior known design, resulting in an approximate material savings of 20%.

Figure 4:
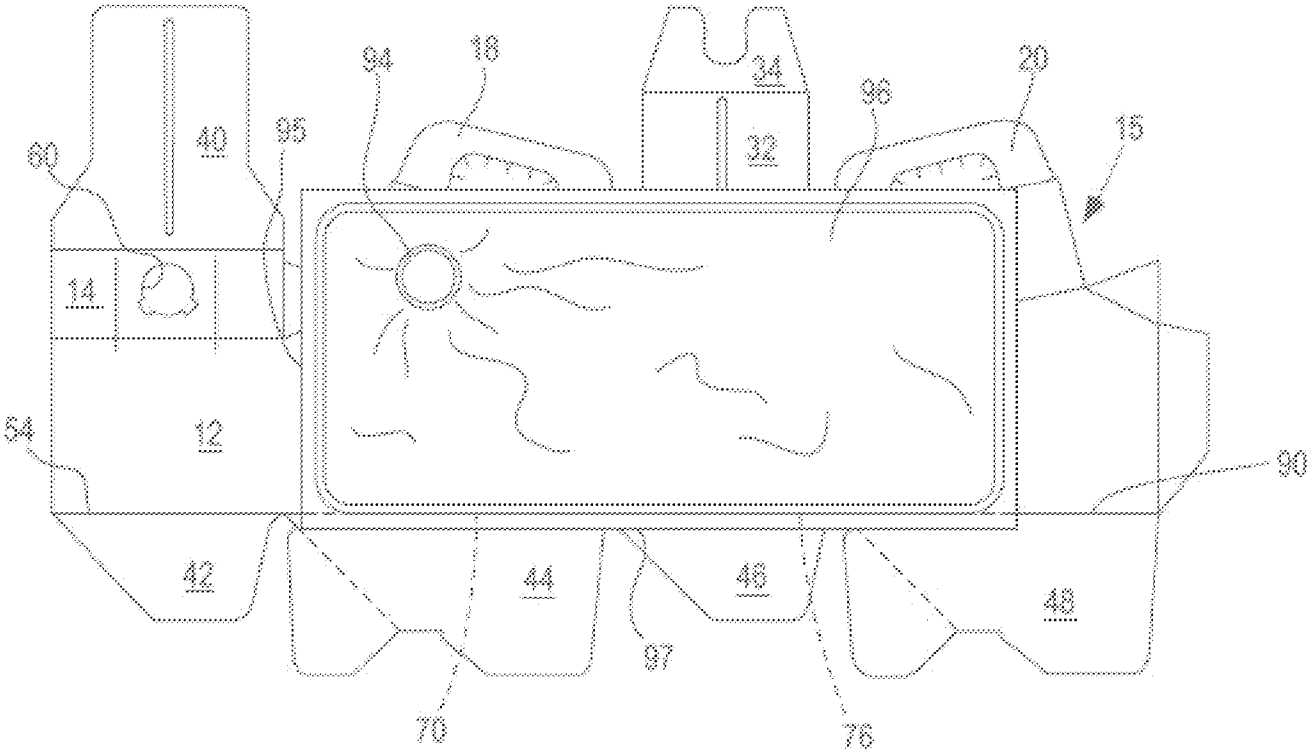
FIG. 4 is a top plan view of the blank of FIG. 3 with a beverage bladder in position for further assembly of the container, the beverage bladder having the spout connected thereto.
Figure 4A:
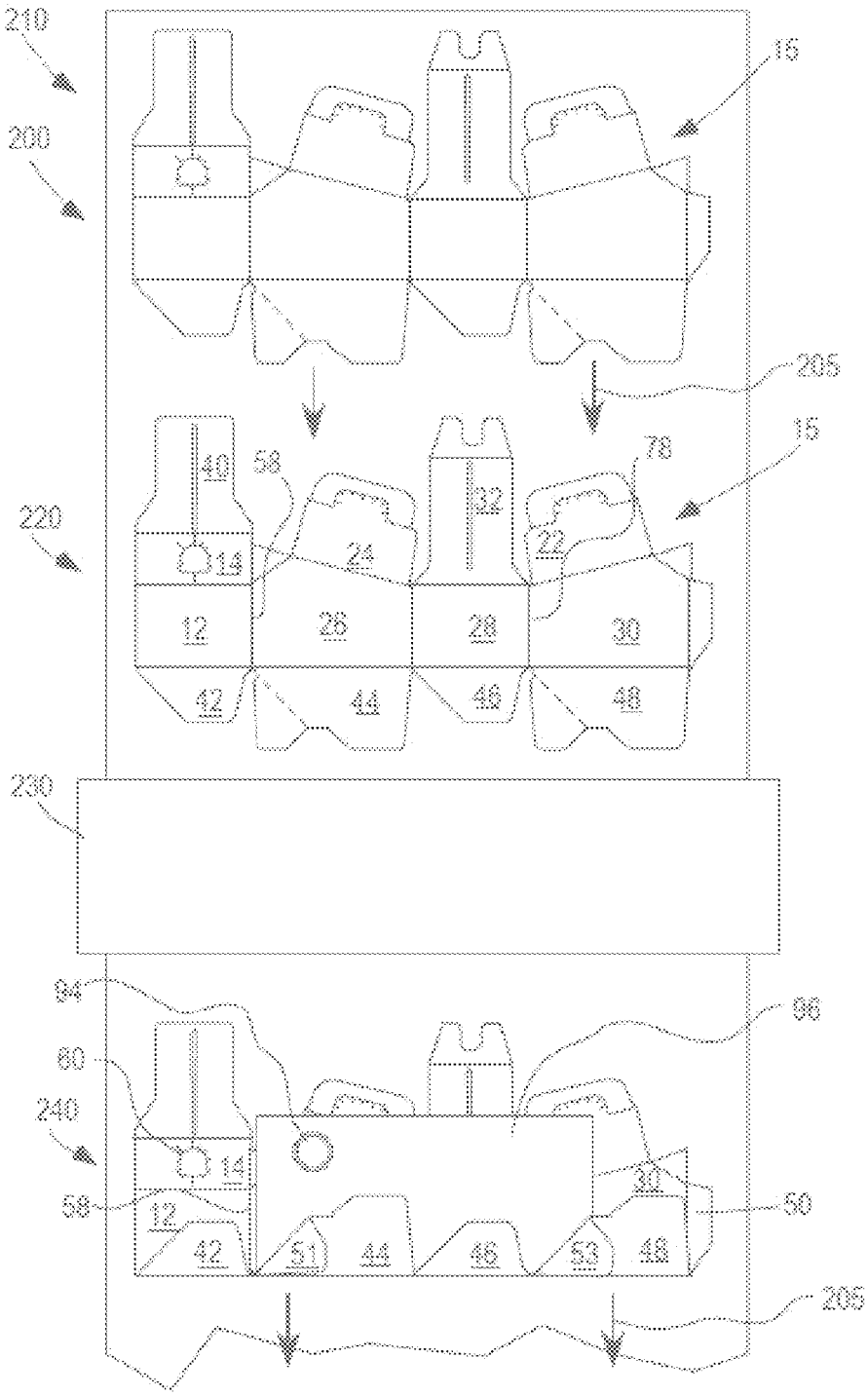
FIG. 4A is a schematic representation of a portion of the manufacturing process for assembling the container of FIG. 1.

Applicant also observed the potential for manufacturing efficiencies. FIG. 4A is a schematic of a portion of the machinery 200 used to automatically assemble the container 10. The container blanks 15 begin at a blank feeding position 210 wherein a stack of blanks 15 are positioned for being introduced into the machinery 200. The blanks 15 are introduced one-by-one laying flat with their bottom flaps 42, 44, 46, and 48 leading as shown at position 220 as the blanks are shifted along a linear machine travel direction 205 through various processes performed at a plurality of stations of the machinery 200, represented by a single "black box" 230. These stations include various folding and gluing stations, as well as a station for assembling the bladder 96 and integrating the bladder with the blank 15. Further details regarding the machinery 200 and the process of manufacturing containers may be found in U.S. Pat. No. 7,066,869, which is incorporated by reference in its entirety herein. After the bladder 94 is joined with the blank 15, the bottom flaps 42, 44, 46, 48 are folded over the walls 12, 26, 28, 30 and the bladder 94 as shown at position 240. The front wall 12 and left wall 30 are then folded over fold lines 58 and 78 respectively to adhesively join the front wall 12 with attachment tab 50, the front bottom flap 42 to flap portion 51, and the rear bottom flap 46 to flap portion 53, thereby forming the container 10 in the collapsed orientation. During this step the aperture 60 is positioned over the spout 94 and the spout passes through the aperture 60, capturing the spout therein. Because the blanks 15 travel through the machinery 200 serially with their height, as measured from the bottom flaps to the top flaps, aligned in the machine travel direction 205, a greater quantity of blanks 15 may pass through the machinery 200 in a given time compared with the prior known container blanks, which have greater heights. This results in higher throughput and production capacity.

Advantageously, the machinery 200 may assemble both prior known containers 310 and the container 10 disclosed herein, with only minor adjustments to the machinery. This is because container blank 15 has the same width orthogonal to the machine travel direction 205 as the prior container 310, and the fold lines 58, 72, and 78 are located in the same relative places, such that the walls of both containers 10, 310 have the same widths. In addition, bottom flaps 42, 44, 46, and 48 have the same configuration as the bottom flaps of the prior container 310. Because only the bottom flaps and walls are folded during assembly, and the top flaps 40, 24, 32, 22 are not folded, the height of the blank 15 does not materially impact the folding operations of the manufacturing process, and the same machinery may advantageously manufacture both containers 10 and prior known containers 310 with minimal changes to the machinery 200, resulting in a quick changeover time. Further, as discussed above, a greater quantity of shorter blanks 15 can be processed in a given time compared with taller blanks of container 310.

Figure 4B:
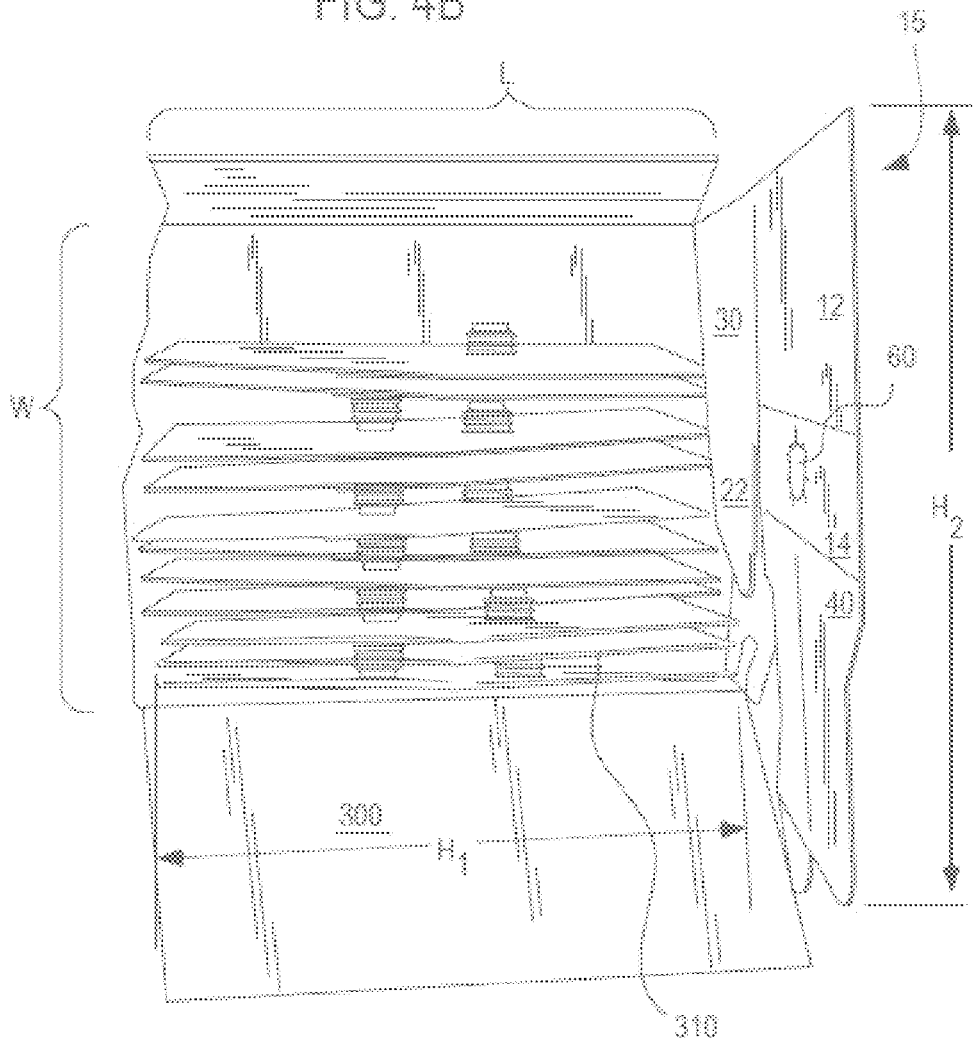
FIG. 4B is a perspective view of a folded blank of the container of FIG. 1 positioned to extend across the width of a shipping box, in which a plurality of collapsed, prior known containers are disposed and oriented to extend along a length of the shipping box.

Another advantage of the present embodiment is that more collapsed containers 10 may be shipped in the same shipping boxes than prior known containers. FIG. 4B shows a shipping box 300 with a plurality of prior known beverage containers 310 in the flat collapsed orientation stacked within the interior of the box 300. The shipping box 300 has a length L and a width W that is shorter than the length L, and each of the collapsed prior containers 310 are oriented with their height $H_1$ (measured from the base of the container 310 to the tip of the longest top flap) extending along the length L of the shipping box. Containers 310 must be oriented this way because their height $H_1$ is longer than the box width W. On the other hand, container blank 15 as described herein is held in a collapsed orientation with its height $H_2$ extending along the width W of the shipping box 300 to illustrate that finished, collapsed containers 10 as described herein may be positioned within existing shipping boxes 300 in a similar manner to the prior containers 310 shown, except with the height $H_2$ of the container 10 extending widthwise with respect to the shipping box 300. This orientation is feasible because the height H2 of the containers 10 is less than the width W of the shipping box 300. Applicant observed an approximate 20% gain in the number of containers 10 that may fit in a standard shipping container 300 compared with prior containers 310, thus reducing shipping and material costs. Further, the same shipping boxes 300 advantageously may be used to ship either prior containers 310 or containers 10 described herein.

Another advantage of the container 10 is that the bladder more effectively occupies the internal space 57 of the container, resulting in numerous performance improvements. For example, when the bladder 96 is filled with a liquid, due to the shorter distance between the spout 94 and the base of container 55 compared with prior known containers, more of the bladder rests on the base of the container 55, reducing the amount of pulling force exerted on the wall portion 14 from which the spout 94 extends. This reduces the likelihood of "turtling" of the spout (i.e. the spout being pulled into the outer shell 11). Further, the bladder 96 is less prone to shifting within the interior space of the container 57 when filled, as the bladder occupies much more of the interior space, leaving less empty space. For example, the bladder of prior known container 310 occupies approximately 50% of the interior space when full, while bladder 96 occupies approximately 60-70% of the interior space 57 of container 10 when full. In addition, the bladder 96 is more securely attached to the front wall 12 and inclined wall portion 14 of the container with the remainder of the bladder being better restrained from moving within the container as it is being filled. It has also been found that due to the forward wall portion 14 and the upward orientation of the spout 94, upon opening of the container from the collapsed orientation, the glue locations that were previously described, cause the bladder to open to a greater degree, allowing the container to receive a much larger volume of fluid within the bladder prior to the fluid acting on the bladder to open the remainder of the bladder. Accordingly, the container 10 provides a faster and more uniform and controlled filling and dispensing of its liquid contents. Furthermore, when more of the bladder is resting on the bottom of the container, especially in the lateral direction (width) of the container, it has been found that the container is more stable during pouring, since the bladder is not permitted to shift about within the unoccupied internal volume of the container as the liquid is being dispensed. Preventing the bladder from suddenly shifting within the cavity of the container results in a steady, predictable flow of dispensed liquid.

Another advantage of having the spout 94 project from an inclined forward wall portion 14 of the container is that it makes the spout 94 more visible during pouring, which allows a user to see the liquid as it flows from the spout 94. With prior known erectable beverage containers, which have a spout emerging horizontally from a vertically extending front wall, the spout can become obscured to the user by the upper front corner of the container as the container is tilted. This makes it very difficult for the user to see the liquid flowing out of the spout when the container is below eye level, which can result in inaccurate pouring from the spout and spillage. A spout located on an inclined wall portion is much more prominent and visible to a user when the container is tilted, allowing for an unobstructed line of sight to the spout 94 when pouring liquid therefrom.

Figure 10:
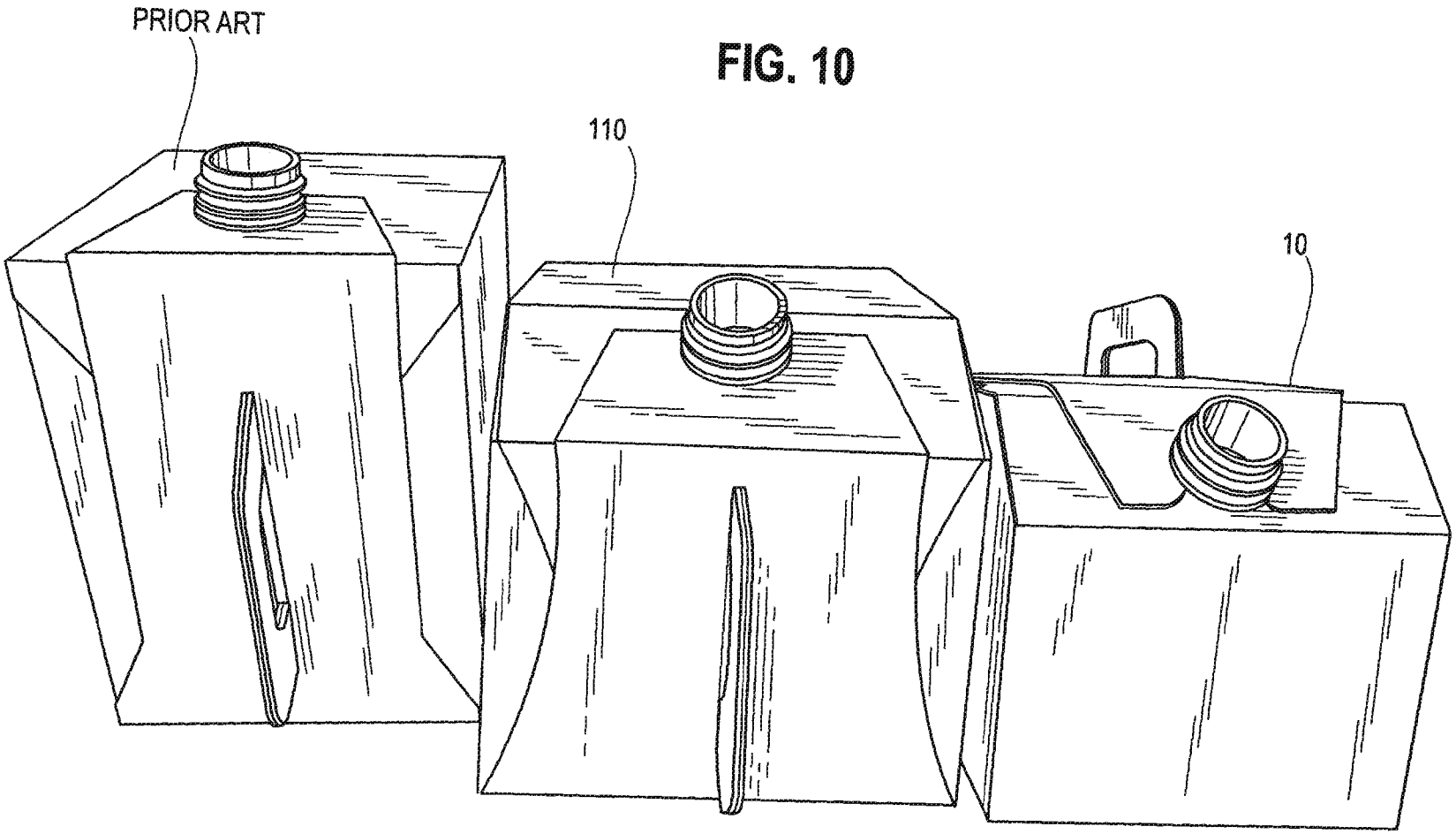
FIG. 10 is a perspective view of a prior art beverage container, the beverage container of FIG. 5, and the beverage container of FIG. 1, from left to right, each in a filling orientation thereof.

As discussed above, including an inclined wall portion allows the beverage container to have a lower profile than previously known erectable beverage containers and it allows the spout to be moved downwardly towards the base of the container. A spout that is lower provides two advantages. First, the spout will be able to fit underneath known commercial coffee brewing machine spigots. This eliminates the step of first dispensing a batch of brewed coffee into a first container and then transferring the contents from that container, by funnel, into the erectable beverage container. In FIG. 10, a prior art beverage container is shown adjacent two embodiments of the beverage container 110, 10 disclosed herein, with each container in a filling orientation. As shown, the prior art beverage container is resting on its rear wall. The second embodiment of the beverage container 110, which will be described in greater detail below, also requires the container to be shifted to a filling position with the rear wall resting on a flat surface, but it should be appreciated that while in the filling position, the spout is significantly lower than the spout of the prior art container, such that the beverage container 110 can be filled directly under the spigot of a commercial brewer. As described above, the beverage container 10 may be filled and transported in the same orientation. Another advantage of a lower spout is that the center of gravity of the container is also lowered, making the container more stable both in transport and when pouring liquid therefrom. In one form, the lateral width of the container compared to the height of the bottom of the spout to the surface that the container rests on in a filling position (i.e. the rear wall of container 110 and the base of container 10) is such that the width to height ratio is at least one or greater.

One constraint with making a shorter container than currently known beverage containers relates to the process used to manufacture the containers and in particular, the placement of the bladder 96 during initial assembly of the container. The bladder 96 has a flat rectangular shape prior to filling it with fluids, as shown in FIG. 4. During the assembly process, the bladder 96 is overlaid on top of the blank 15 with its spout 94 facing upwardly. The left edge of the bladder 95 is positioned adjacent the front right fold line 58 and the bladder 96 extends along the width of the blank 15 with the lower edge 97 of the bladder generally parallel with the aligned fold lines 70, 76, 90 of the bottom flaps 44, 46, 48. In previously known methods, the lower edge 97 of the bladder 96 would have to be positioned such that it did not extend over the fold lines 70, 76, 90 of the bottom flaps 44, 46, 48, because during manufacturing, the bottom flaps 44, 46, 48 are folded upwardly in order to glue and assemble the base 55 of the container. If the lower edge of the bladder 97 is too close to or only slightly over the fold lines 70, 76, 90 of the bottom flaps, the folding of the bottom flaps 44, 46, 48 along these lines can push the bladder upwardly toward the top flaps, causing the spout 94 to be out of alignment with the aperture 60, which causes the failure of the spout 94 to extend through the aperture 60, resulting in a defective container. However, the inclined wall portion 14 and the associated reduction in height of the blank 11 allows the position of the aperture 60 to be substantially lower and closer to the bottom flap fold lines 70, 76, 90, such that a bottom portion of the bladder 97 extends over the bottom flap fold lines and over a portion of the bottom flaps 44, 46, 48 such that the bladder bottom edge 97 is disposed on the flaps 44, 46, 48. If the bladder 96 lies far enough over the bottom flap fold lines 70, 76, 90, the bladder 96 will simply fold upwardly along the bottom flap fold lines 70, 76, 90 when the bottom flaps are folded upwardly (see FIG. 4A), rather than being pushed upwardly by the flaps. Advantageously, the temporary folding of the bladder 96 along the bottom flap fold lines 70, 76, 90 does not result in any reduction in performance of the bladder 96, as the bladder will unfold itself when the container 10 is erected and a liquid is introduced. Accordingly, the same beverage bladder 96 could be used for both taller beverage containers, such as previously known containers having vertical front walls and horizontal spouts, as well as shorter beverage containers, such as one with an inclined wall portion and spout disclosed herein. In a currently preferred form, the bladder in an unexpanded configuration has dimensions of 18×8.75 inches and when fully expanded within the container 10 has a capacity of approximately 112 ounces, although a wide range of bladder sizes and capacities could be used.

In the embodiment of FIGS. 1-4B, the walls, including front wall 12, are all vertically upright, i.e., they extend perpendicularly from the base 55. However, in other forms, the walls may extend from the base at a variety of angles, such as in the embodiment shown in FIGS. 5-8.

An alternate embodiment of an erectable beverage container 110 having a vertically upwardly extending spout 194 extending from an inclined wall portion 114 is shown in FIGS. 5-8. The present embodiment is similar to the embodiment of FIGS. 1-4B with several exceptions, including the inclined wall portion 114 having less of an incline, and the walls are also inclined with respect to the base 155, as will be described in more detail hereinafter. Portions of the container 110 correlating to previously described portions of the container of FIGS. 1-4 will be labeled with the same number, with the addition of 100 to the number. For example, the spout, labeled 94 in the previous embodiment, is labeled 194 in the present embodiment.

Figure 5:
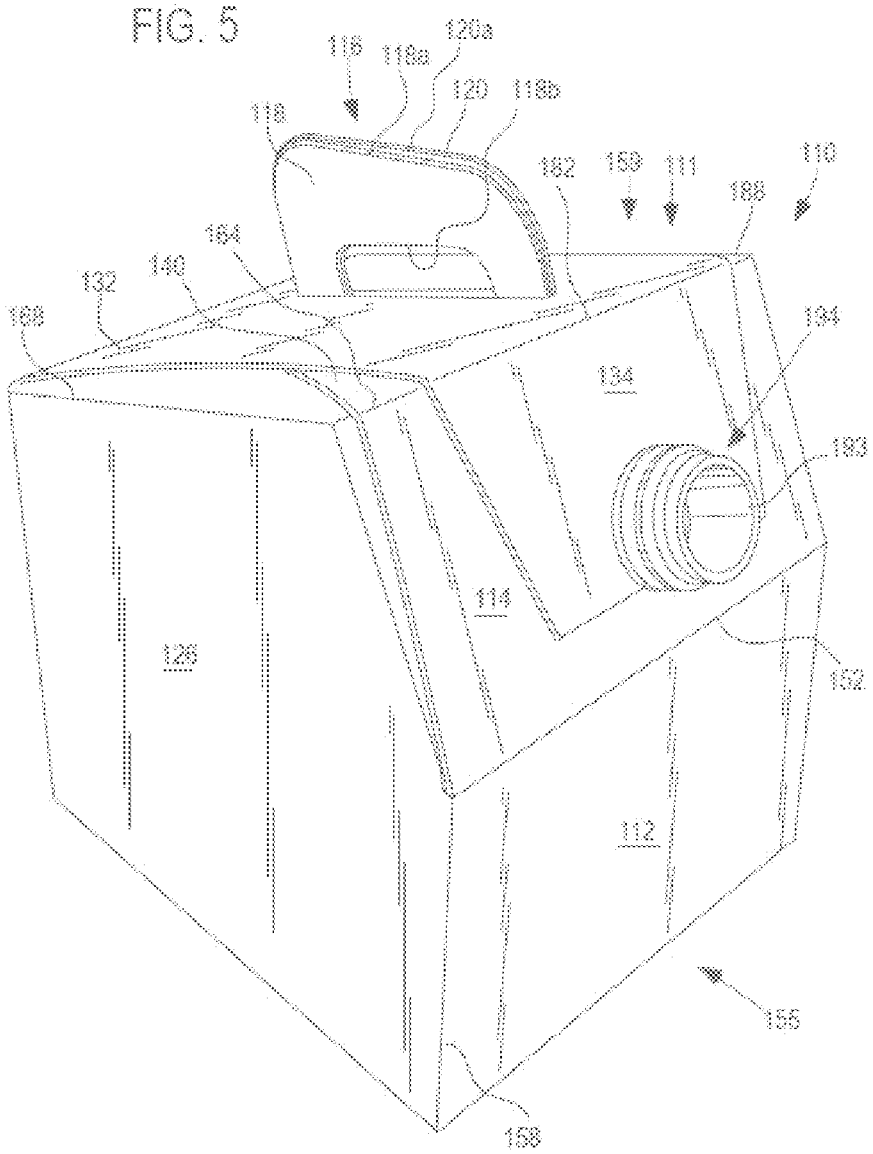
FIG. 5 is a perspective view of an alternative beverage container showing an upper, inclined forward portion of the container body having a spout extending generally orthogonal therefrom.

FIG. 5 illustrates a perspective view of the beverage container 110. As shown in FIGS. 5-8, the container 110 includes a container body formed by an outer shell 111 including a front wall 112, a left sidewall 130, a right sidewall 126 and a rear wall 128. The front wall 112 is hingedly attached along a right front fold line 158 to the right sidewall 126. The right sidewall 126 in turn is hingedly attached along a right rear fold line 172 to the rear wall 128. The rear wall 128 is hingedly attached along a left rear fold line 178 to the left sidewall 130. An attachment tab 150 is hingedly attached to the left sidewall 130 along a left front fold line 192. Adhesive is applied to the opposite (outer) side of the attachment tab 150 for securing the tab to the inside surface of the front wall 112. The container 110 has tapered walls, such that each of the walls extends slightly outwardly at an obtuse angle from the rectangular base 155. In one preferred form, the front wall 112 extends at an angle (with respect to a vertical reference axis extending from the base) of approximately 9-15 degrees, the right and left sidewalls 126, 130 each extend at angle of approximately 2-6 degrees, and the rear wall 128 has an angle of approximately 2-6 degrees with respect to the base 155, although other orientations may be used. As shown in FIG. 7, the front and rear walls 112, 128 have non-parallel edges 156, 158 and 172, 178, such that the upper edges 152, 174 are longer than the respective base edges 154, 176. The front and rear walls 112, 128 have quadrilateral configuration, while the right and left sidewalls 126, 130 have a pentagonal or 5-sided configuration. The base 155 of the container 110 has a generally flat configuration for stably resting on a flat surface, such as a table. The top 159 of the container 110 has a first inclined portion 163 which increases in elevation from the rear top fold line 174 to the apex of the container 161. Handle 116 extends upwardly from this first inclined portion 163 to provide for easier pouring when the container 110 is held by the handle 116. A second inclined forward portion in the form of inclined transition wall portion 114 extends between the front wall 112 and the first inclined portion 163 of the container top 159, the two inclined portions meeting at the apex 161, as will be described further below.

As shown in FIG. 7, the outer shell 111 is formed from a single one-piece blank 115. The inner surface of the blank 115 is shown with the opposite, outer surface being on the other side. The blank 115 includes a series of top and bottom flaps for forming the top and bottom of the container 110. All of the flaps remain in the open, unfolded configuration with the container 110 in a collapsed orientation for shipping until the container is fully erected and assembled by a user into a filling orientation for introducing a liquid into the container. The blank 115 includes a top right flap 124 and a top left flap 122 that extend from a top edge 168 of the right sidewall 126 and a top edge 188 of the left sidewall 130, respectively. The top right and left flaps 124, 122 further include right and left handle flaps 118 and 120, respectively, that are hingedly connected thereto via fold lines 127 and 129. Right and left tab portions 125, 123 extend from the top right and left flaps 124, 122 and are bordered on their sides by the right and left handle flaps 118, 120, respectively. When the handle flaps 118, 120 are folded about fold lines 127 and 129, the right and left tab portions 125, 123 remain in the same plane as the top right and left flaps, 124, 122, respectively, such that openings defined by the handle flaps 118, 120 are unobstructed by the tab portions 125, 123 and are sized and configured to accept the hand of a user. When the container 10 is assembled for filling with a beverage, the handle members 118, 120 are folded into an upright closed configuration with the right and left tab portions 125, 123 overlapping one another and extending through the openings formed by the of the opposite handle flaps 120, 118 and the inner surfaces of the handle flaps 118, 120 are brought into engagement with each other to form a handle 116 that enables one-handed carrying of the container 110, as well as one-handed pouring.

Figure 6:
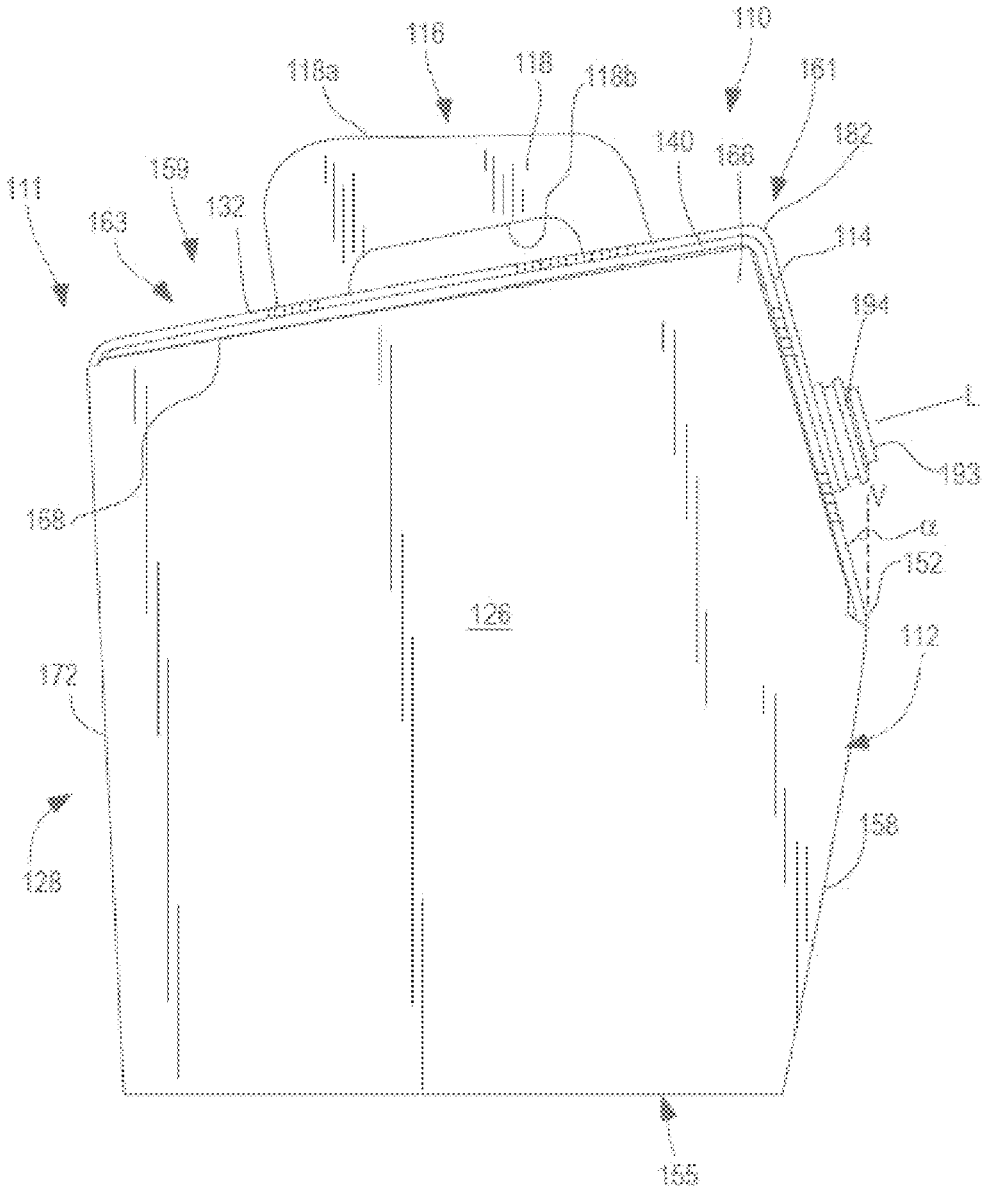
FIG. 6 is a side elevational view of the container of FIG. 5.
Figure 7:
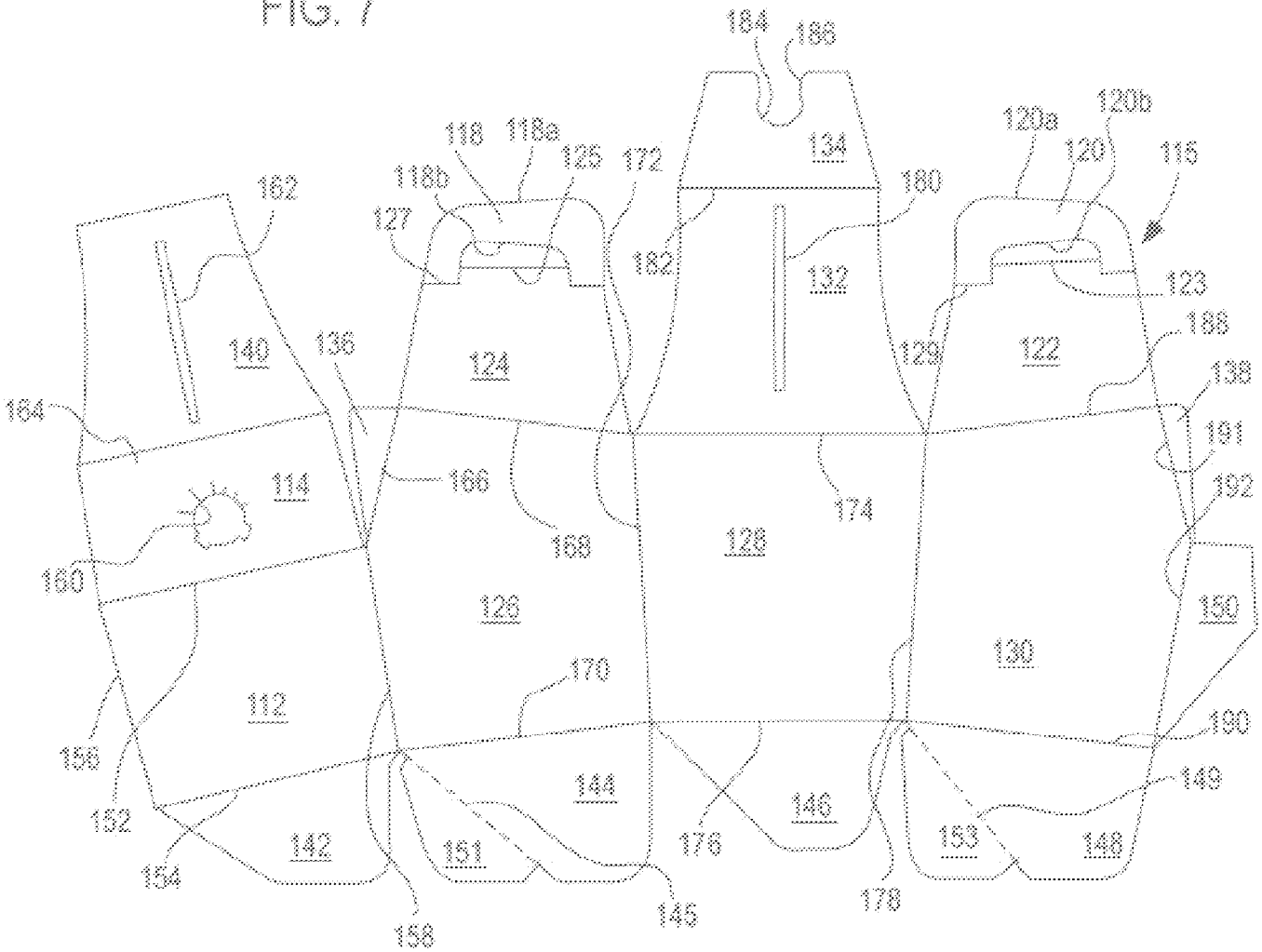
FIG. 7 is a top plan view of a blank from which the container of FIG. 5 is constructed.

As shown in FIGS. 6 and 7, the handle flaps 118, 120 taper down from a rearward portion to a forward portion thereof. In particular, the handle flaps 118, 120 are formed such that the upper edge portions 118*a*, 120*a* thereof are not parallel to the inner edge portions 118*b*, 120*b*, unlike the handle members 18, 20 of the first embodiment shown in FIG. 3. In particular, the inner edge portions 118*b*, 120*b* are substantially parallel to the fold lines 127, 129 from which the handle flaps 118, 120 extend. The outer edges 118*a*, 120*a* are inclined with respect to the fold lines 127, 129 such that the rearward portion of the outer edges 118*a*, 120*a* are further from the fold lines 127, 129 than the forward portion thereof. As a result, the handle flaps 118, 120 are thicker towards the rear and thinner near the front as shown in FIG. 6. When in the assembled, expanded configuration, the outer edges 118*a*, 120*a* are not inclined at the same angle as the container top 159, which improves the ergonomics of pouring by allowing the user to pour liquid from the container with a more comfortable orientation of the arm, hand, and wrist.

The container top 159 is further formed by forward top and rearward top flaps 140 and 132 that extend from a top edge 164 of the inclined wall portion 114 and top edge 174 of the rear wall 128, respectively. A spout locking flap 134 is hingedly connected along fold line 182 to the rear top flap 132. The spout locking flap 134 includes opposite finger portions 186 spaced apart by an arcuate portion 184 sized to fit around the spout 194 to keep the spout from falling through the aperture 160 and into the interior 157 of the erected container 110. The finger portions 186 are preferably sized and configured to provide an interference fit with the outer perimeter of the spout 194 for securing the flap 134 to the spout. The forward top and rearward top flaps 140, 132 are configured to be folded inwardly toward one another over the top of the container 110 for securing the container in the fully assembled configuration shown in FIG. 5. As shown in FIG. 3, each flap member 140 and 132 defines a slot 62, 80, respectively through which the handle flaps 118, 120 extend when the top right and left flaps 124, 122 are folded inwardly over the opening of the container 110 and the handle members 118, 120 are folded so as to extend vertically upward in a side-by-side arrangement. The front top flap 140 is first folded over the top right and left flaps 124, 122 and the handle flaps 118, 120 are inserted from below through the slot 162. The rear top flap 132 is then folded over the front top flap 140 and the vertically extending handle flaps 118, 120 are inserted through slot 180, such that the rear top flap 132 rests flat against the outer surface of the front top flap 140. The spout locking flap 134 may then be positioned about the spout 94 as shown in FIG. 5.

Figure 8:
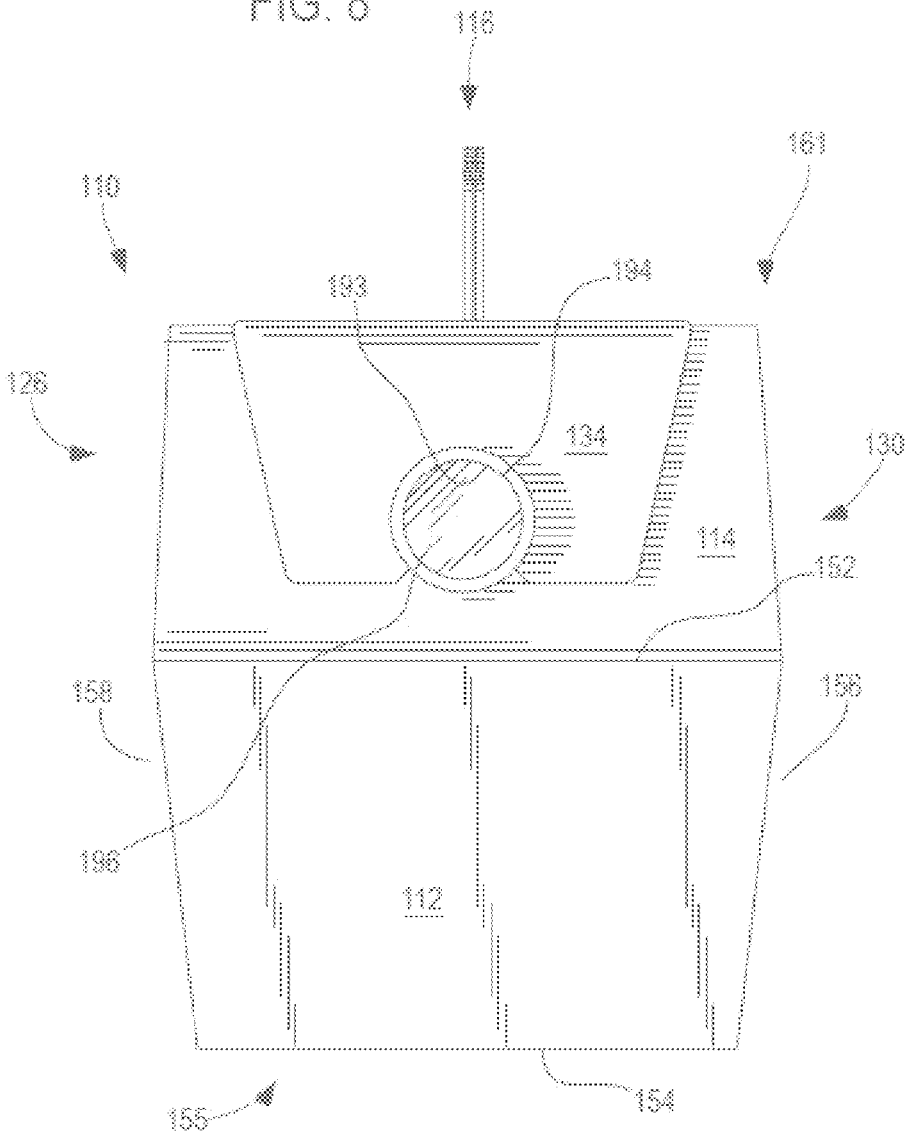
FIG. 8 is a front view of the container of FIG. 5.

The top right and left flaps 124, 122 and the handle flaps 118, 120 may be configured such that there is a gap between the handle flaps 118, 120 when the top right and left flaps 124, 122 are folded toward one another and the handle flaps 118, 120 are folded onto their upright orientation, but prior to folding down the front top flap 140 and rear top flap 132, which are the final two flaps that are folded during assembly. The purpose of this gap is to pull the upper portions of the right and left sidewalls 126, 130 toward one another when the handle flaps 118, 120 are brought together be inserted through the slots 162 and 180 of the front top and rear top flaps 140, 132. When the handle flaps 118, 120 are brought together, the upper portions of the right and left sidewalls 126, 130 must flex slightly inwardly. This flexing gives the right and left sidewalls 126, 130 a convex profile to closely match the profile of the inclined wall portion 114, which decreases in width from bottom to top, as shown in FIG. 8.

The container top 159 advantageously has its apex 161 spaced rearwardly from the front wall 112. In this form, the spout locking flap fold line 182 is also spaced rearwardly from the front wall 112 and specifically the top edge 152 of the front wall, which allows the rear top flap 132 to be reduced in length over prior known containers. Similarly, front top flap fold line 164 is spaced rearwardly from the front wall 112 and top edge 152 thereof, allowing for a similar reduction in length of the front top flap 140, corresponding with a reduction in material.

The bottom or base 155 of the container 110 is formed by a plurality of bottom flaps, including front bottom flap 142, which is hingedly connected along fold line 154 to the front wall 112. Right bottom flap 144 is hingedly connected to right sidewall 126 along fold line 170. Rear bottom flap 146 is hingedly connected to the rear wall 128 along fold line 176, and left bottom flap 148 is hingedly connected to the left sidewall 130 along fold line 190. Flap portion 151 is hingedly connected to right bottom flap 144 along a perforated fold line 145, and similarly flap portion 153 is hingedly connected to left bottom flap 148 along perforated fold line 149. During initial assembly of the collapsed container, flap portions 151, 153 are adhesively connected to the outer surfaces of front bottom flap 142 and rear bottom flap 146, respectively, via an adhesive, such as a cold set adhesive applied to either the flap portions 151, 153 or the front and rear bottom flaps 142, 146. Advantageously, after the bottom flaps are glued together, the bottom flaps are folded inwardly with the inner surfaces of the flaps 142, 144, 146, 148 laying against the inner surfaces of the walls 112, 126, 128, 130. The bottom flaps 142, 144, 146, 148 are constructed such that they may be easily shifted from this folded configuration with the container 110 in a collapsed orientation, to a generally flat configuration to form the base 155 when the container is expanded by a user into its fill orientation, as is known in the art. When assembled into the fill orientation, the respective walls 112, 126, 128, 130, top flaps and bottom flaps form a closed interior space 157 therebetween in which the beverage bladder 196 resides.

The container 110 advantageously includes an inclined wall portion 114 that extends from the top edge 152 of the front wall 112. The inclined wall portion 114 defines an aperture 160 through which a portion of a spout 194 of the bladder 196 extends. The aperture 160 includes a plurality of radial slits to form a plurality of tabs around the aperture 160 for engaging with the outer perimeter of the spout 194 with an interference fit, while avoiding tearing of the material around the aperture 160 when the spout 194 is inserted through the aperture 160.

Unlike the embodiment of FIGS. 1-4, the inclined wall portion 114 and spout 194 are not sufficiently inclined to allow pouring of liquid, such as from vertically oriented spigot, directly into the container without an excessive amount of care when the container rests on its base 155 or is held such that the base is oriented substantially horizontally. Accordingly, this embodiment is designed to be filled with the rear wall 128 resting on a flat surface, or with the container 110 being held in a similar orientation with the spout 194 extending substantially vertically. In this embodiment, the inclined wall portion 114, aperture 160, and the opening of the spout 193 are each oriented in a plane oriented at an angle $\alpha$ with respect to vertical (i.e. axis V extending perpendicularly from the base), such that the spout body 94, which extends generally perpendicularly from the inclined wall portion 114 at a complimentary angle to a, is oriented at least partially vertically upwardly. In other words, the longitudinal axis L about which the spout 194 extends is inclined with respect to a horizontal plane defined by the flat base 155. As with the previous embodiment, the inclined wall portion 114, and similarly the aperture 160 or opening of the spout 193, may have a variety of inclined orientations. The inclined wall portion 114 could alternatively be oriented with a sufficient horizontal component such that liquid may be poured directly into the container 110 while the base 155 is horizontal. The present embodiment, while not providing for filling and transporting of the container in the same orientation, provides other benefits, such as a reduction in material (on the order of 20% from a prior known container) while maintaining the same fluid capacity, reduced spillage when transporting the container 110 without a cap, and improved visibility of the spout during pouring, as well as reduction of drips after pouring due to the vertically inclined spout 194.

Similarly to the first disclosed embodiment, a hot melt adhesive may be applied at adhesive locations on either side of the aperture 160 for bonding the bladder 196 to the inclined wall portion 114 and front wall 112. Because the bladder 196 is adhesively attached to interior surface of the inclined wall portion 114 and the spout 194 is captured within the aperture 160 in the inclined wall portion 114, any weight of the liquid that is not supported by the base 155 of the container 110 will be supported by the inclined wall portion 114 and indirectly, the surrounding walls. Accordingly, the right and left sidewalls 126, 130 may be provided with support shoulder flaps or tabs 136, 138 to provide additional support to the inclined wall portion 114. The support shoulder tabs 136, 138 have a triangular shape and are hingedly connected to the respective right and left sidewalls 126, 130 along fold lines 166, 191. The fold lines 166, 191 follow the same incline as the inclined wall portion 114 when the container 110 is assembled. During assembly, the support tabs 136, 138 are folded underneath the inclined wall portion 114 and lay against the inner surface thereof, such that when liquid is poured into the container 110, the support shoulder tabs 136, 138 provide additional support to the inclined wall portion 114 to keep the inclined wall portion 114 from being pulled inwardly into the interior of the container 157 by the liquid in the bladder. In other forms, the support tabs 136, 138 could be omitted.

Figure 9:
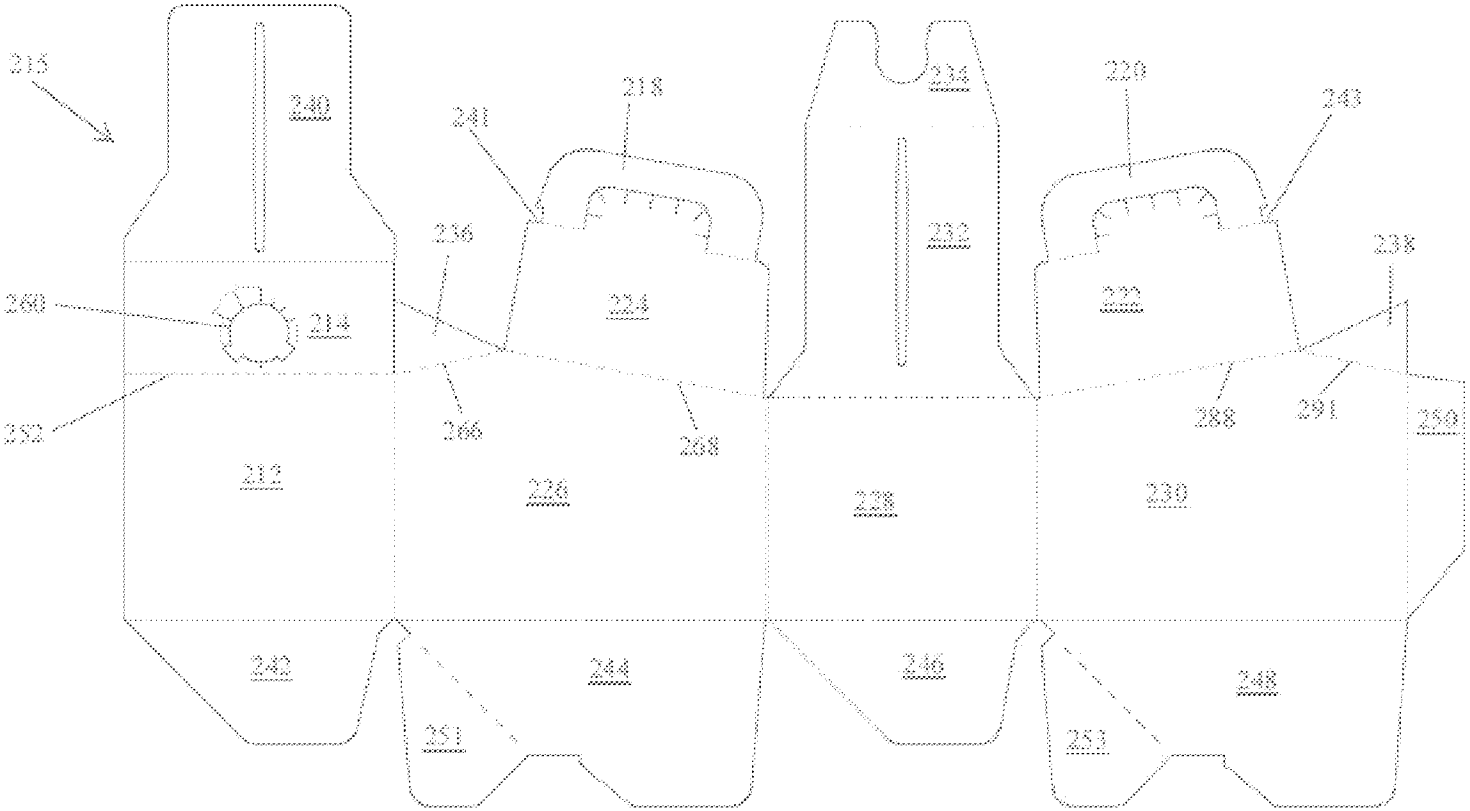
FIG. 9 is a top plan view of a blank of an alternative beverage container.

An alternate embodiment of an erectable beverage container blank 215 is shown in FIG. 9. Although not necessarily described again herein, portions of the blank 215 correlating to previously described portions of the blank 15 in FIG. 3 is labeled with the same numbers, with the addition of 200 to the number. The blank 215 is similar to the blank of the first embodiment shown in FIG. 3, except that blank is configured such that the inclined wall portion 214 is inclined to a greater degree from vertical, i.e. has a flatter incline with respect to the flat base. In particular, the inclined wall portion 214 is configured such that in the assembled, expanded configuration, the inclined wall portion 214 is oriented at an angle of 80 degrees with respect to a vertical line extending from the base. To compensate for this modification, the shoulder flaps 236, 238 are slightly elongated relative to the embodiment of FIG. 3. Further, the apex of the assembled container is lower and located further away from the front wall 212.

The other main difference from the embodiment shown in FIG. 3 is that the handle flaps 218, 220 are configured with notches 241, 243 located at an outer edge of the flaps and adjacent the fold lines from which the handle flaps 218, 220 extend adjacent top right and top left flaps 224, 222 so as to align with each other when the blank 215 is erected to a beverage container. The notches 241, 243, which could be provided in any embodiment, are configured to receive portions of the forward and rearward top flaps 240, 232 adjacent the slots 262, 280 therein to secure the top flaps more securely together. The notches 241, 243 are preferably sized to correspond with two times the material thickness of the forward and rearward top flaps 240, 232, such that the notch formed by the aligned notches 241, 243 of the handle flaps 218, 220 can accommodate both flaps therein. The notches 241, 243 are effective to keep the top of the container from separating, and are particularly useful in embodiments wherein the inclined wall portion 214 has a flatter incline with respect to the base.

While various embodiments of the invention have been described, it will be apparent to those of ordinary skill in the art that many more embodiments and implementations are possible that are within the scope of the invention. Accordingly, it will be apparent to those of ordinary skill in the art that various alterations, modifications, and adaptations may be based on the present disclosure, and are intended to be within the scope of the invention as defined by the following claims.

What is claimed is:

1. An erectable container comprising:

a container body formed from a single unitary blank configured to be erected from a collapsed orientation into an expanded orientation for receiving, transporting, and pouring a liquid, the container body in the expanded orientation having a flat base, a top, and a front wall, a rear wall, and opposing side walls extending between the container top and base cooperating to form an interior space;

a flexible bladder having an interior for storing liquid therein, the bladder being disposed in the container body interior space and the bladder including a spout having an opening in communication with the bladder interior to provide a liquid passageway thereto; and the container body top having a first inclined portion oriented obliquely relative to the flat base extending from the rear wall up toward an apex;

a handle portion of the container body extending up from the first inclined portion for transporting and manipulating the container;

a second inclined portion of the container body top including an inclined wall portion oriented obliquely relative to the flat base extending from the front wall up toward the apex and including an aperture through which the spout extends.

2. The erectable container of claim 1, wherein the front wall extends obliquely from the base.

3. The erectable container of claim 1, wherein the second inclined portion is oriented at an angle between 55 and 85 degrees with respect to a vertical axis perpendicular to the flat base.

4. The erectable container of claim 1, wherein the second inclined portion is oriented at an angle between 5 to 35 degrees with respect to a vertical axis perpendicular to the flat base.

5. The erectable container of claim 1 wherein the first inclined portion is oriented at first predetermined acute angle with respect to a vertical axis perpendicular to the flat base, and the second inclined portion is oriented at a second predetermined acute angle with respect to a vertical axis perpendicular to the flat base, and the first predetermined acute angle is larger than the second predetermined acute angle.

6. The erectable container of claim 1, wherein the top of the container body includes a rearward top flap extending from the rear wall that forms part of the first inclined portion and a spout locking flap that extends from the rearward top flap and forms part of the second inclined portion, wherein the spout locking flap overlies the inclined wall portion and includes a spout engaging portion that is configured to extend about at least a portion of the spout to keep the spout from being pulled into the interior space through the aperture.

7. The erectable container of claim 6, wherein the apex of the container body top extends between the opposing side walls and is cooperatively formed by an edge between the inclined wall portion and a forward top flap extending from the inclined wall portion and an edge between the rearward top flap and the spout locking flap that overlies the edge between the inclined wall portion and the forward top flap.

8. The erectable container of claim 1, wherein the first and second inclined portions intersect at the apex at an angle of between 90 and 135 degrees.

9. The erectable container of claim 1, wherein a support shoulder tab extends from each of the opposing side walls, the support shoulder tabs each configured to extend along an interior surface of the inclined wall portion to provide support thereto.

10. The erectable container of claim 1, wherein the bladder is attached to an inner surface of the inclined wall portion with an adhesive.

11. The erectable container of claim 1, wherein the container body top includes a rearward top flap and a forward top flap, and the handle portion includes a notch for receiving a portion of each of the rearward and forward top flaps for securing the top flaps therein.

12. The erectable container of claim 1, wherein at least one of the opposing side walls and the rear wall of the container body extends from the base at an obtuse angle with respect thereto.

13. The erectable container of claim 1, wherein the first and second inclined portions are each oriented at a predetermined angle with respect to a vertical axis perpendicular to the flat base, and the predetermined angle of the second inclined portion is smaller than the predetermined angle of the first inclined portion.

14. The erectable container of claim 1, wherein the first inclined portion extends along a length towards the apex, and the second inclined portion extends along a length towards the apex, and the length of the first inclined portion is greater than the length of the second inclined portion.

15. The erectable container of claim 1, wherein an uppermost portion of the apex is spaced from the base by less than 7 inches.

16. A collapsible beverage container blank formed from a unitary sheet of material, the beverage container blank comprising:

a front wall having an upper edge with a top wall portion extending therefrom;

the top wall portion having an aperture for receiving a spout therein, and an upper edge with a forward top flap extending therefrom;

a first side wall having an upper edge with a first top flap extending therefrom;

a first handle flap extending from the first top flap;

a rear wall having an upper edge with a rearward top flap extending therefrom;

a second side wall having an upper edge with a second top flap extending therefrom; and a second handle flap extending from the second top flap;

wherein the forward and rearward top flaps each include an elongate slot for receiving the first and second handle flaps therethrough;

wherein the top wall portion and the forward, rearward, first, and second top flaps are configured to form a beverage container top having first and second inclined portions that meet at an apex spaced from the front wall when the beverage container blank is assembled into an expanded configuration, with the top wall portion forming the second inclined portion and the forward and rearward top flaps forming the first inclined portion with the first and second handle flaps extending from the first inclined portion in an upright orientation.

17. The beverage container blank of claim 16, wherein a shoulder flap extends from each of the first and second side walls and each shoulder flap is configured to engage with an inner surface of the top wall portion in the expanded configuration of the beverage container blank for providing support to the top wall portion.

18. The beverage container blank of claim 16, wherein the first and second handle flaps each comprise a notch therein that are aligned together for receiving a portion of the forward and rearward top flaps therein with the beverage container blank in the expanded configuration.

19. The beverage container blank of claim 16, further comprising a spout locking flap extending from the rearward top flap configured to lay over the top wall portion with the beverage container blank in the expanded configuration, the spout locking flap including a spout engaging portion configured to extend about at least a portion of a spout extending through the aperture in the top wall portion.

20. The beverage container blank of claim 16, wherein the front wall includes a pair of side edges extending from a bottom edge thereof and diverge apart from one another as the side edges extend to the upper edge of the front wall such that the front wall is wider at the upper edge than at the bottom edge.

21. The beverage container blank of claim 16, wherein each of the first and second handle flaps taper down between outer and inner surface portions thereof from a rearward portion to a forward portion thereof.

22. The beverage container blank of claim 16, further comprising a flexible bladder having spout for receiving fluid therein with the spout received in the aperture in the top wall portion prior to being assembled into the expanded orientation.

* * * * *